US009856604B2

(12) United States Patent
Sorrentino et al.

(10) Patent No.: US 9,856,604 B2
(45) Date of Patent: Jan. 2, 2018

(54) INSULATION FOR CYLINDER HEADS

(71) Applicant: A. CELLI PAPER S.P.A., Capannori (IT)

(72) Inventors: Salvatore Sorrentino, Pinerolo (IT); Mauro Celli, Lucca (IT); Giuseppe Antonini, Lido di Camaiore (IT)

(73) Assignee: A. CELLI PAPER S.P.A., Capannori (IT)

( * ) Notice: Subject to any disclaimer, the term of this patent is extended or adjusted under 35 U.S.C. 154(b) by 0 days.

(21) Appl. No.: 15/029,368

(22) PCT Filed: Oct. 13, 2014

(86) PCT No.: PCT/IB2014/065271
§ 371 (c)(1),
(2) Date: Apr. 14, 2016

(87) PCT Pub. No.: WO2015/056154
PCT Pub. Date: Apr. 23, 2015

(65) Prior Publication Data

US 2016/0222588 A1 Aug. 4, 2016

(30) Foreign Application Priority Data

Oct. 15, 2013 (IT) ..... FI2013A0241

(51) Int. Cl.
*D21F 5/02* (2006.01)
*D21F 5/18* (2006.01)

(52) U.S. Cl.
CPC ..... *D21F 5/181* (2013.01); *D21F 5/021* (2013.01)

(58) Field of Classification Search
CPC ..... D21F 5/181
USPC ..... 162/289; 5/181, 21, 2, 18
See application file for complete search history.

(56) References Cited

U.S. PATENT DOCUMENTS

| | | | | |
|---|---|---|---|---|
| 4,385,453 | A | 5/1983 | Withers, Jr. et al. | |
| 4,399,169 | A * | 8/1983 | McGowan | D21F 5/021 138/109 |
| 4,464,849 | A | 8/1984 | Gamble | |
| 4,520,578 | A | 6/1985 | Schiel et al. | |
| 4,878,299 | A | 11/1989 | Wedel | |
| 5,667,641 | A * | 9/1997 | Poirier | D21F 5/021 162/207 |
| 6,623,601 | B2 * | 9/2003 | Graf | B29C 70/84 162/272 |
| 2002/0060023 | A1 * | 5/2002 | Kaihovirta | D21F 5/021 162/207 |

(Continued)

FOREIGN PATENT DOCUMENTS

| | | |
|---|---|---|
| WO | 2010/049804 A2 | 5/2010 |
| WO | 2013/087597 A1 | 6/2013 |
| WO | 2013/117975 A1 | 8/2013 |

*Primary Examiner* — Mark Halpern
(74) *Attorney, Agent, or Firm* — McGlew and Tuttle, P.C.

(57) ABSTRACT

The cylinder (1; 111) comprises: a shell (3; 113) and two heads (5, 7; 115, 117), defining an inner hollow space (9), inside which a heat-transfer fluid flows. Support and rotation journals (15, 17; 121, 123) are also provided, fixed to said heads; and a thermal insulation system (23, 25; 125, 125) for the heads (5, 7, 117, 119). The thermal insulation system comprises, for each head, a plurality of thermal insulation panels (27; 127), each of which comprises a closed space (10) defined in a shell, inside which there is housed a thermal insulating material (35).

25 Claims, 24 Drawing Sheets

(56) References Cited

U.S. PATENT DOCUMENTS

| | | | | |
|---|---|---|---|---|
| 2003/0181303 | A1* | 9/2003 | Leinonen | D21F 5/022<br>492/46 |
| 2015/0129149 | A1 | 5/2015 | Consolato et al. | |

* cited by examiner

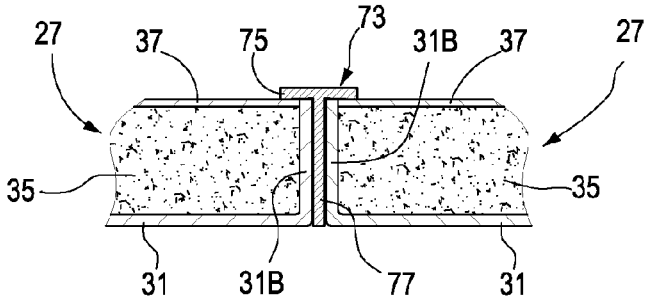
Fig.2A
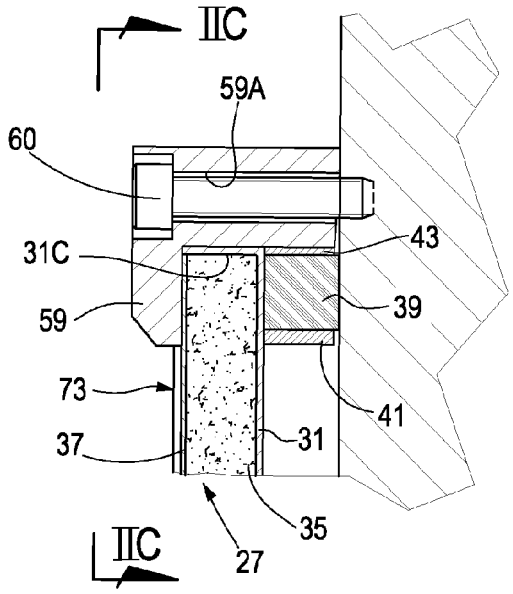
Fig.2B
Fig.2C
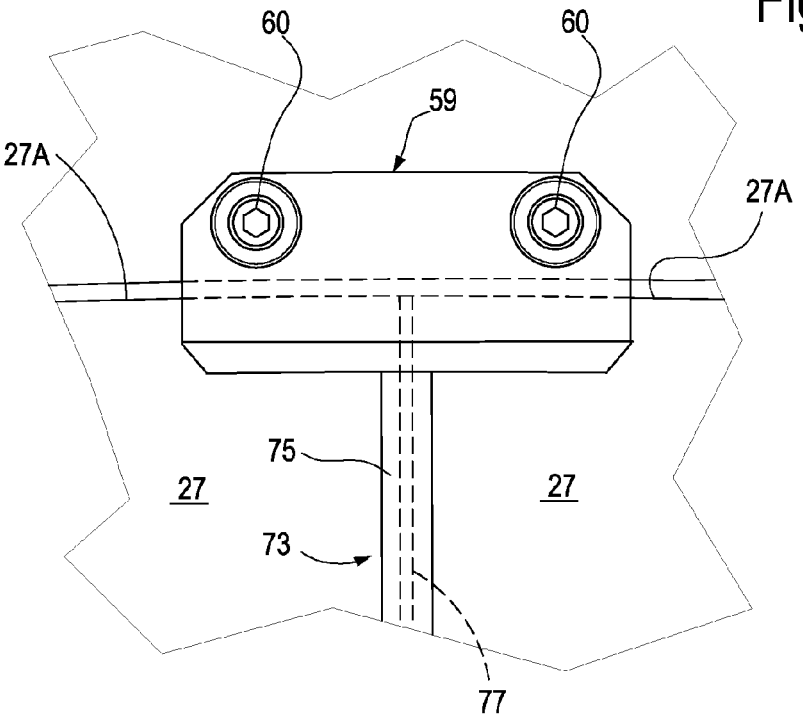

27A
27X
XIIIC
XIIIC
29
59
73
XIIIA
XIIIA
27
27
XIIIB
XIIIB
27
73
27
61
27
73
27
27
27
59
27X 111
113
115
115T
117
119
121
123
125
127
127A
127B
127E
130
131
132
137
139
141
143
147
35
10
A
XXA
XXB
XXI

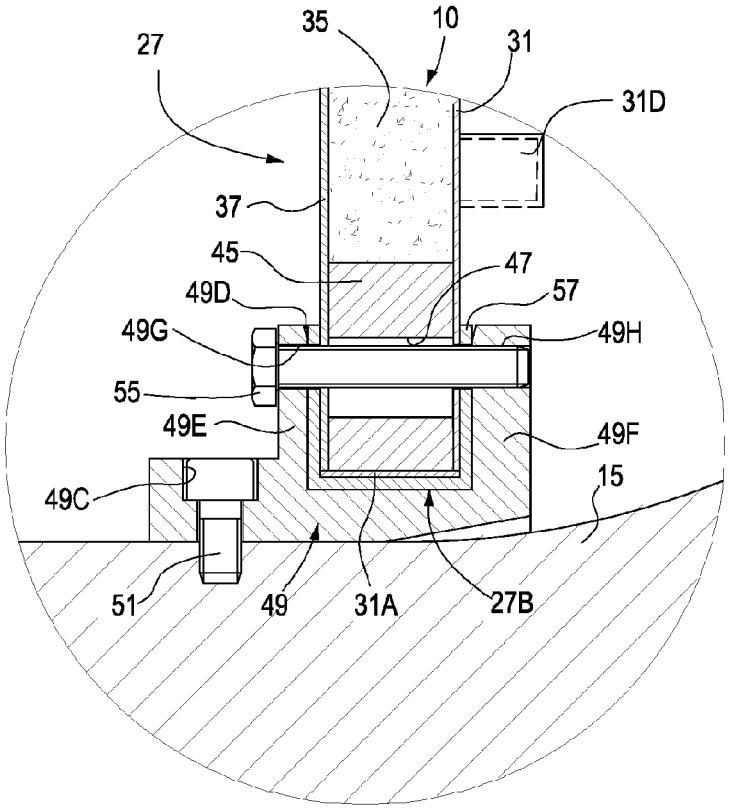
Fig.24
Fig.25
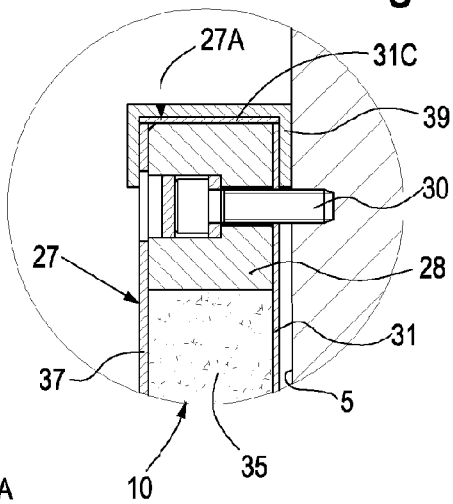
Fig.26
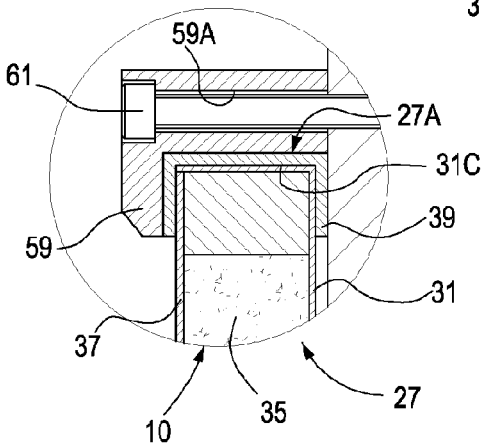

INSULATION FOR CYLINDER HEADS

This application is a 371 of PCT/IB2014/065271 filed on 13 Oct. 2014.

TECHNICAL FIELD

Embodiments described herein relate to improvements to machines, parts of machines and components of industrial plants, especially heated cylinders. Some embodiments relate to improvements to Yankee cylinders and dryers for plants for paper production, especially for paper wet production. More in particular, the invention relates to improvements allowing saving energy in the above mentioned plants, resulting in a reduction in pollutant emissions and in lower heat discharge into the environment.

STATE OF THE ART

Reducing the energy consumption has always been a crucial issue for some industries, for instance the paper industry. U.S. Pat. No. 4,520,578 and U.S. Pat. No. 4,878,299 disclose thermal insulation systems for dryers or Yankee cylinders designed to reduce the heat losses through the heads thereof.

The Yankee cylinders are usually insulated by applying rock wool pillows to a metal sheet that is fixed to the cylinder head.

The insulations made of these materials have large thickness and low efficiency. Moreover, they are likely to be affected by wear and decay due to high temperature. Over time, the rock wool looses its thermal insulation features.

The increased energy costs and the greater environmental responsibility are continuous stimuli to search increasingly effective solutions for consumption reduction, also using innovative products.

There are insulation systems using foam materials; even if they contribute to reduce heat losses, however they are not efficient as they include significant quantities of air.

WO-A-2013/087597 discloses an insulation system for Yankee cylinders and dryers, wherein the heads are provided with an outer insulation constituted by segments of metal sheet welded and/or bolted to one another and to the head. A closed-cell and open-cell polymeric coating is sprayed onto the metal sheet; the cells provide the insulation layer with a high content of hollow volumes, i.e. volumes containing air, in the order of 15-30%. The insulation layer is applied onto the sheet surface facing the head.

This insulation structure is unsatisfactory due to many reasons. First of all, it is difficult to be applied to existing Yankee cylinders, and it is therefore not suitable for retrofitting of existing plants, as it would require very long down times. Moreover, the spray application, suggested in the above mentioned publication, entails material dispersion into the environment. The non-rigid nature of the insulating material causes problems in balancing the cylinder.

The fact that the insulation is directly applied to the head of the Yankee cylinders makes the periodic maintenance operations of the components difficult or even impossible, and may hide steam losses from the cylinder that, in case they are not promptly detected, may have catastrophic consequences for the cylinder structure.

The fact that the insulation is directly applied to the head of the Yankee cylinder may also hide oxidation phenomena, and this can result in a lower mechanical resistance of the cylinder and even in a reduction in the head thickness.

Moreover, in case steam flows out from the Yankee cylinder, the insulating material, which is water-soluble, may degrade or even liquefy, this resulting in a lower functionality of the Yankee cylinder and in a change of the dynamic balance thereof.

The high amount of air inside the hollow spaces contained in the insulating material reduces the thermal insulation efficiency, as air has greater heat conductivity than the insulating materials.

U.S. Pat. No. 4,399,169 discloses an insulation system for heads of cylinders, wherein an adhesive insulating material is applied to the outer surface of the Head.

The insulating material, stuck or sprayed, is not efficient and performance reduction and decay of chemical and physical features are very likely due to the contact with the moisture that exists in large amounts in many plants, especially in paper wet production plants.

There is therefore the need for an insulation system for the heads of dryer cylinders and Yankee cylinders that entirely or partially overcomes one or more of the drawbacks of the existing systems.

SUMMARY OF THE INVENTION

According to embodiments described herein, a cylinder is provided, for instance a Yankee cylinder or a dryer cylinder, comprising a shell and two heads, defining an inner hollow space, inside which a heat-transfer fluid flows. The cylinder may also comprise support and rotation journals fixed to the heads and a thermal insulation system for the heads, comprising a plurality of insulation panels for each head. Each insulation panel may comprise a closed space defined in a shell, inside which a thermal insulating material is housed. In this way, each insulation panel surrounds and protects the thermal insulating material arranged therein.

The space surrounded by the shell and containing the thermal insulating material may be advantageously waterproof sealed and, as the case may be, air- and steam-proof. In this way, the thermal insulating material is better protected against degradation due, for instance, to steam present in the environment, which can alter, reduce or compromise the thermal insulation features of the material.

In some advantageous embodiments the thermal insulating material comprises a polymeric matrix where one or more of the following components are dispersed: glass particles, rock wool, clay particles, montmorillonite particles, preferably montmorillonite nanoparticles. Preferably in the polymeric matrix a combination of three components, typically glass particles, rock wool and clay particles, or montmorillonite particles, or also both clay and montmorillonite, is dispersed.

The thermal insulating material may be advantageously in the form of sheets, panels or plates that are applied, for instance glued or otherwise, inside the space defined in the insulation panel.

The shell surrounding the thermal insulating material may be made of a metal sheet, for instance by a wall facing the head and by a cover. The wall and the cover may be welded together or joined otherwise so as to insulate the whole space against the outside. Gaskets may be provided in some embodiments.

In some embodiments, the thermal insulating material is shaped in the form of sheets, plates or the like, starting from a suspension or a dispersion in a dispersing liquid, typically (although not exclusively) water. The percentage by weight of the starting dry matter, i.e. the matter before the dispersing liquid is added, may be as follows:

glass spheres 5-40% by weight;

rock wool 5-40% by weight;

clay and/or montmorillonite 0.5-5% by weight polymer, for instance acrylic polymer, 10-40% by weight.

The single percentages, chosen within the indicated ranges, amount preferably to 100, i.e. the thermal insulating material is formed starting from a composition constituted by the four components indicated above, to which the dispersing liquid is added. The quantity of dispersing liquid to be added is such to achieve the proper viscosity for the specific use, which can be defined by means of traditional optimization criteria known to those skilled in the art. Fire-resistant or flame-retardant compounds, for instance phosphor compounds, may be added to the polymer.

Advantageously, after having been solidified and hardened, the thermal insulating material is substantially without cavities. "Substantially without cavities" means that the hollow volume (i.e. the volume containing air) inside the material is lower than 10%, preferably lower than 3% and more preferably lower than 2% of the total volume, thus generating a particularly compact, efficient and temperature-resistant material.

In advantageous embodiments, a plurality of adjacent insulation panels may be provided. The panels may be shaped like segments of an annulus. The insulation may have therefore an annular configuration. Each panel may comprise an outer shell surrounding a plate or a plurality of plates of thermal insulating material.

In some embodiments, each panel may have a support wall for the thermal insulating material, that can be made for instance of metal sheet. This wall may have bent edges, for instance radial and respective radially inner and radially outer circumferential edges, to delimit a space for containing the sheet or plates of thermal insulating material. This space for containing the thermal insulating material may be closed by means of a cover, made for instance of metal or plastic, such as polycarbonate. The wall and the cover may be welded together, preferably by means of seam weld, or otherwise sealed together, for instance by means of silicone resins or the like, to provide a water-proof and, if necessary, air-proof seal. In other embodiments, especially in the case the materials used for producing the wall and/or the cover do not allow welding, a gasket can be used to seal them together. In some embodiments the gasket may be a high-temperature silicone gasket.

The edges of the wall forming part of the shell or case for containing the thermal insulating material can be produced by bending the sheet forming this part, or can be applied, for instance welded or glued, in the form of inserted elements along the edges of a flat sheet.

In some embodiments, to firmly fix the head insulation panels to the Yankee cylinder or the dryer cylinder, mounting rings may be provided, preferably comprised of two or more portions mounted around the respective support and rotation journals of the Yankee cylinder or dryer cylinder. These rings may have an annular groove where the inner circumferential edges of the single insulation panels engage.

In advantageous embodiments, the joint between the panel and the mounting ring is such to allow a differential heat expansion of the panel with respect to the cylinder head. To fasten them together screws can be for instance used, that engage the mounting ring passing through slots that extend radially in the panel.

To reduce the heat flow between the Yankee cylinder or dryer cylinder and the insulation panel, a high-temperature gasket may be provided between the inner circumferential edge of the panel and the mounting ring. The gasket may extend along the inner circumferential edge and may advantageously have a C-shaped or U-shaped cross-section.

Each insulation panel may be fastened to the head along the outer circumferential edge by means of screws and/or fastening brackets or clamps. This joint along the outer circumferential edge may be such as to prevent the relative motion between insulation system and head, as any differential heat expansion can be compensated by means of the fastening along the inner circumferential edge, for instance by means of the aforementioned radially extending slots. The joint along the outer circumferential edge is such as to resist the centrifugal stresses applied onto the insulation panels as a result of the high-speed rotation of the Yankee cylinder or the dryer cylinder.

In some embodiments, a high-temperature gasket is provided along the outer circumferential edge, for instance a silicone gasket, whose cross-section is preferably U- or C-shaped and which insulates the panel with respect to the head and the fastening brackets or clamps, to limit the direct heat flow between the head and the insulation panel.

According to a further aspect, a method is provided for thermally insulating cylinder heads, the method comprising the steps of:

providing a thermal insulation panel with a closed space, wherein a thermal insulating material is housed, applying a plurality of said panels to the cylinder head.

In some embodiments, the method comprises the step of forming a sheet or plate of thermal insulating material comprising a polymeric matrix where one or more of the following components are dispersed: clay particles, montmorillonite particles, glass particles, rock wool.

A combination is preferably used of the above mentioned components, or of at least two of these components, for instance clay particles and/or montmorillonite particles and glass particles or clay particles and/or montmorillonite particles and rock wool.

The clay or montmorillonite particles have preferably nanometric dimensions.

In advantageous embodiments, the method provides for producing a layer of polymeric material containing one or more dispersed components and a dispersing liquid acting as viscosity controller, if necessary. This layer is then dried and hardened, forming a thermal insulating material substantially without cavities and therefore having high thermal insulation capacity with respect to other known polymer-based components.

According to a further aspect, the invention also relates to an insulation panel for high-temperature components of plants, comprising a shell defining a closed volume, inside which a thermal insulating material is inserted, the volume being preferably water-proof and, if necessary, air-proof sealed. The thermal insulating material can advantageously comprise a polymeric matrix where one or more of the following components are dispersed: glass particles, rock wool, clay particles or nanoparticles, montmorillonite particles or nanoparticles.

Generally, the insulation panel can be applied to any component of a paper wet production plant, and in particular to components having an inner volume at least partially surrounded by a wall dividing the inner volume from an outer space, for instance from the environment, where there is a temperature different than, and typically lower than the inner temperature. The insulation panel can be used to insulate the heads of dryer cylinders and Yankee cylinders, as well as other components, for instance air hoods for Yankee cylinders in the paper wet production plants, steam and hot air ducts and pipes, etc.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention will be better understood by means of the description below and the attached drawing, which shows a non-restrictive practical embodiment of the invention. More in particular, in the drawing:

FIGS. 2A and 2B show enlarged cross-sections according to the lines $II_A$-$II_A$ and $II_B$-$II_B$, FIG. 2C is a front view according to the line $II_C$-$II_C$ of FIG. 2B;

FIG. 24 shows an enlargement of the detail indicated with XXIX in FIG. 23;

FIG. 25 is a cross-section according to XXV-XXV of FIG. 22;

FIG. 26 shows an enlargement of the detail indicated with XXVI in FIG. 23;

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Insulation of a Yankee Cylinder (FIGS. 1 to 11)

In FIGS. 1 to 11 a first embodiment is shown of a thermal insulation according to the invention, associated with a Yankee cylinder used in the wet production plants for producing cellulose plies, for instance paper, tissue paper, cardboard or the like.

Figure 1:
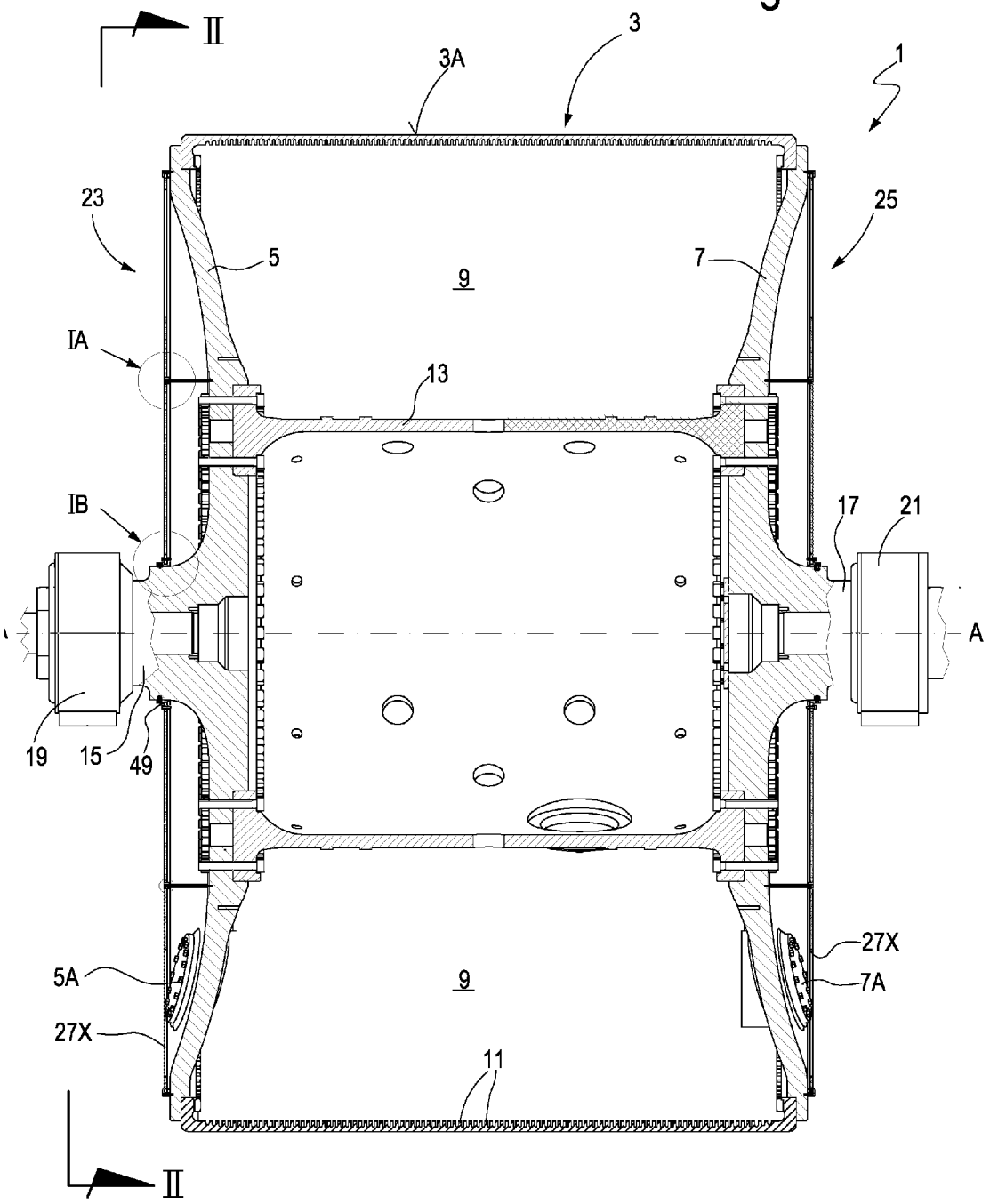
FIG. 1 is a cross-section, according to a plane containing the axis of rotation A-A, of a Yankee cylinder with an insulation system according to a first embodiment of the invention.

In FIG. 1, number 1 indicates the Yankee cylinder as a whole. The Yankee cylinder comprises for instance a cylindrical body or shell 3 provided with heads 5 and 7. In the illustrated example, the heads 5 and 7 have a round shape, with the concavity facing the outside.

The shell 3 is provided with an outer cylindrical surface 3A and forms, together with the heads 5 and 7, a closed space 9, inside which a heat-transfer fluid, such as steam, flows. The heat-transfer fluid circulating inside the Yankee cylinder 1 releases heat to both the heads 5, 7 and the shell 3. Around the Yankee cylinder a ply of cellulose material is driven, which shall be at least partially dried by means of the heat transferred from the steam or other heat-transfer fluid through the cylindrical shell 3.

The heat transferred through the heads 5 and 7 constitutes an energy loss that shall be reduced, using an insulation system as described herein, to increase the energy efficiency of the plant where the Yankee cylinder operates, thus reducing the production costs and the environmental impact.

The inner surface of the cylindrical shell 3 may be provided, in a known manner, with annular grooves 11, where ducts (not shown) enter, for sucking condensate collected in the grooves 11 as a result of the transfer of the latent heat of vaporization through the shell 3 during the operation of the Yankee cylinder.

The heads 5 and 7 may be connected to one another by means of an inner tie rod 13.

The heads are provided with respective support and rotation journals indicated with 15 and 17. These journals 15 and 17 may be inserted inside support bearings, for instance ball bearings schematically indicated with 19 and 21.

In some embodiments, one or both the heads 5 and 7 may be provided with a manhole 5A, 7A to access the interior 9 of the Yankee cylinder, for instance for maintenance or control.

A thermal insulation is associated with each head 5, 7, namely a thermal insulation 23 associated with the head 5 and a thermal insulation 25 with the head 7. The two thermal insulations 23 and 25 may be substantially mirror-like, and therefore only one of them will be described below.

Figure 2:
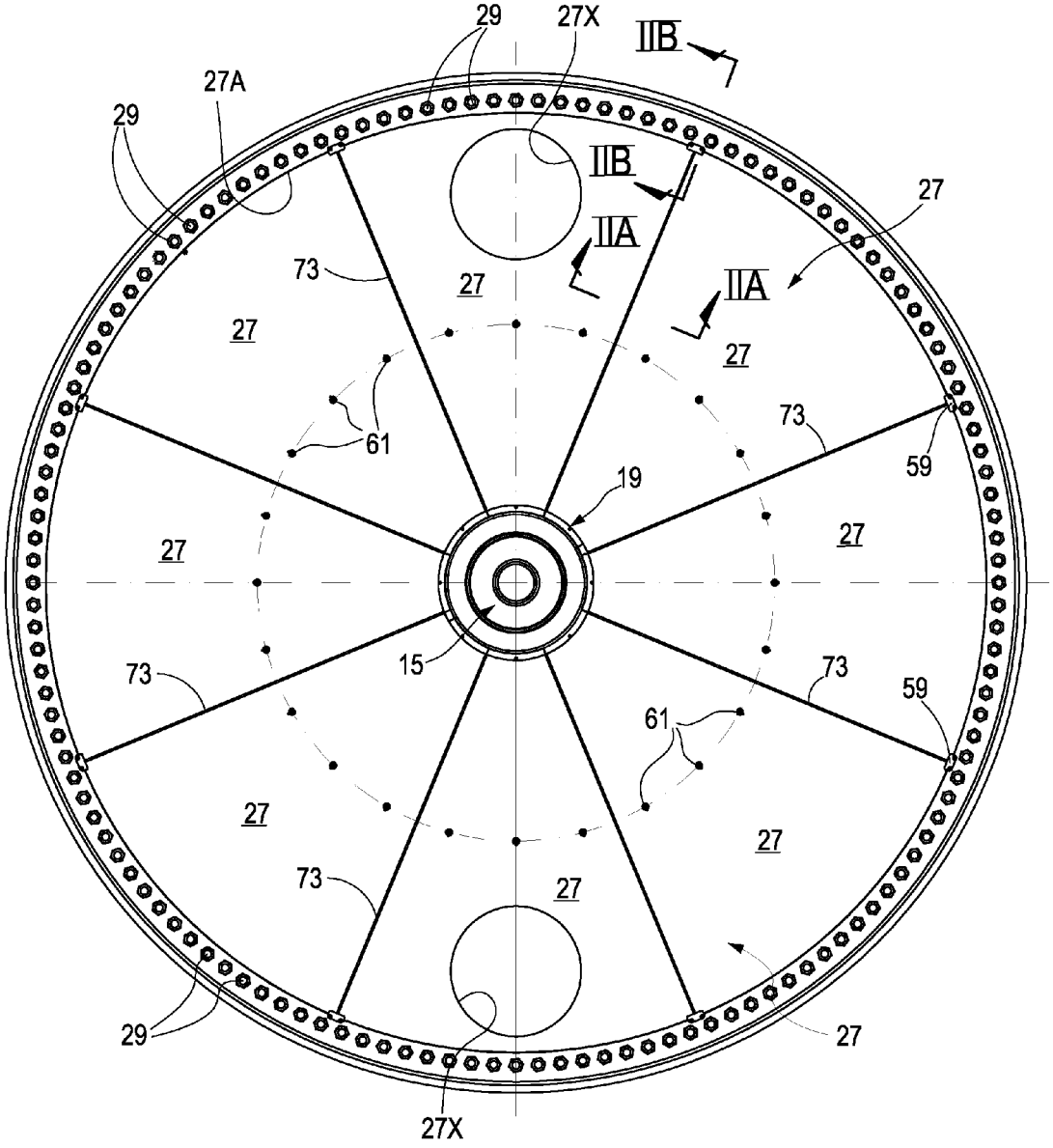
FIG. 2 is a front view according to the line II-II of FIG. 1.

As it is shown in particular in the front view of FIG. 2, the insulation system may comprise, in some embodiments, a plurality of adjacent insulation panels 27, so as to form an annular insulation substantially extending from the respective support and rotation journal 15, 17 up to the most external circumferential area of the head 5, 7, near the area where the head is fixed to the shell 3.

As it is shown especially in FIG. 2, in some embodiments the heads 5, 7 are fixed to the shell 3 by means of bolts 29 arranged in an crown-like fashion around the most external circumferential edge of the respective head. In some embodiments the insulation panels 27 may extend up to the crowns of bolts 29. In other embodiments, not shown herein, the insulation panels 27 may have a greater radial dimension, thus covering the heads of the bolts 29.

In further embodiments, the heads 5, 7 and the shell 3 may be joined together with no need for screws nor bolts, for instance they may be welded together. In this case it would be more convenient to bring the insulation panels 27 up to the most external annular edge of the respective head, thus further reducing the heat loss through the heads 5, 7.

Eight insulation panels 27 are provided in the illustrated example (see in particular FIG. 2). This configuration is given just by way of example, as the number of panels used to form an insulation system of a single head may be greater or lower than that illustrated herein. In some embodiments, at least one insulation panel 27 is provided with an opening 27X for accessing the respective manhole 5A, 7A provided in the respective head 5, 7.

Figure 3:
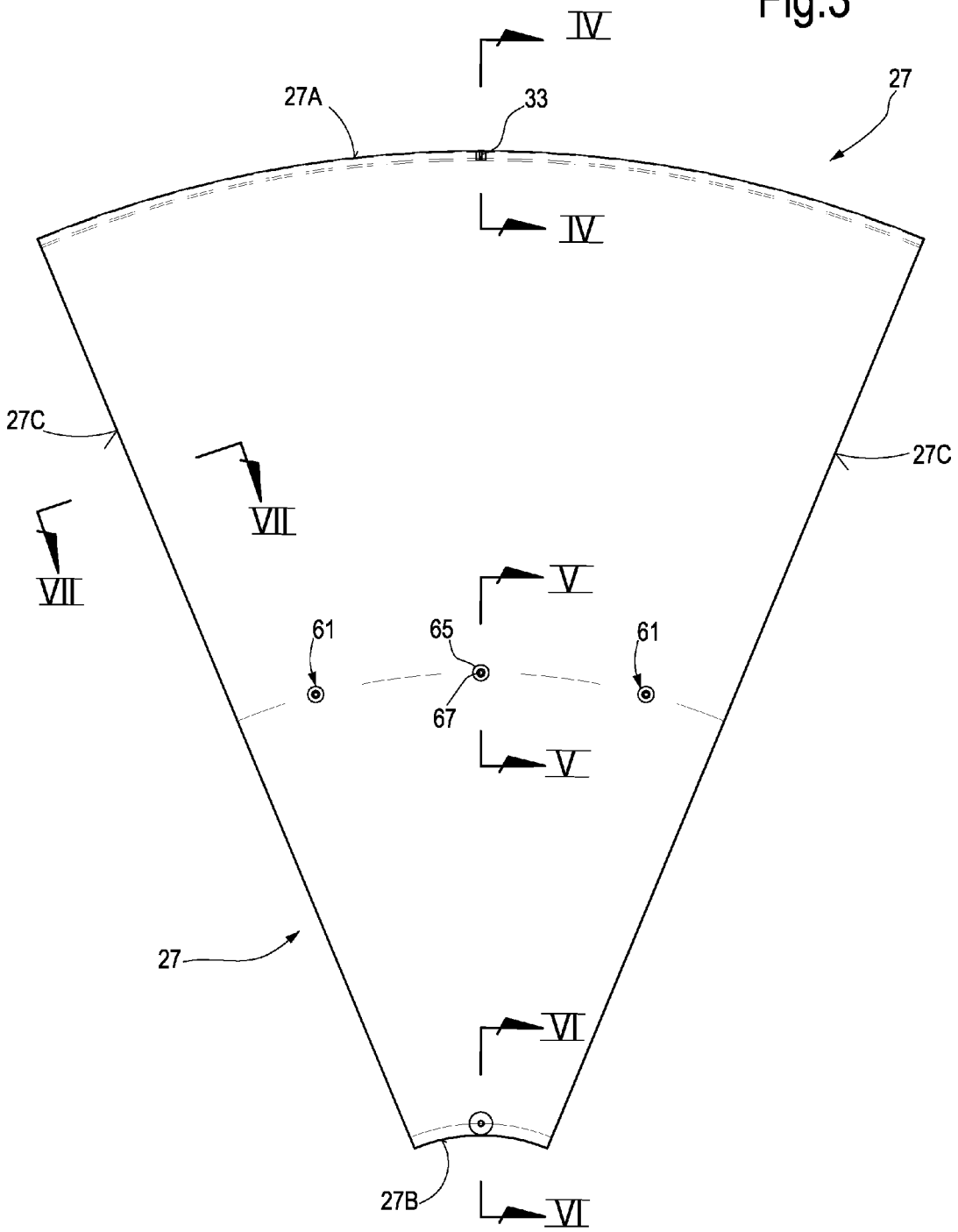
FIG. 3 is a front view of an insulation panel.

FIG. 3 is a front view, from the side of the head, of an insulation panel 27, shown separately from the adjacent panels. The panel 27 may be shaped like a segment of an annulus. In some embodiments, the panel 27 may advantageously have an outer circumferential edge 27A, an inner circumferential edge 27B and two preferably nearly rectilinear radial edges 27C.

In some embodiments, each panel 27 may comprise a wall, made for instance of metal, to which a sheet or layer of thermal insulating material is applied. In some embodiments, more plates of smaller dimensions may be provided instead of a sheet. For example, the wall may be made of steel, aluminum or other suitable metal in the form of plate or sheet. The wall is indicated with 31 in the details of FIGS. 4, 5, 6, and 7. As it is particularly clearly apparent in FIGS. 6 and 7, the wall 31 may have bent circumferential edges indicated with 31A and 31C. The bent edge 31A of the sheet metal forming the wall 31 defines the inner circumferential edge 27B of the panel 27, while the bent edge 31C defines the outer circumferential edge 27A thereof. Moreover, the wall 31 may have bent edges 31B, each of which defines a respective substantially rectilinear radial edge 27C of the panel 27. The thermal insulating material, in the form of sheets or plates, may be inserted in a volume 10 delimited by the bent edges 31A, 31B, 31C and then covered with a covering plate, as described below. In some embodiments, the sheets or plates of thermal insulating material may be glued onto the metal wall 31. In other embodiments, one or more bent edges 31A, 31B and 31C may be replaced by metal sheet portions welded to the wall 31 along the edges thereof.

Figure 4:
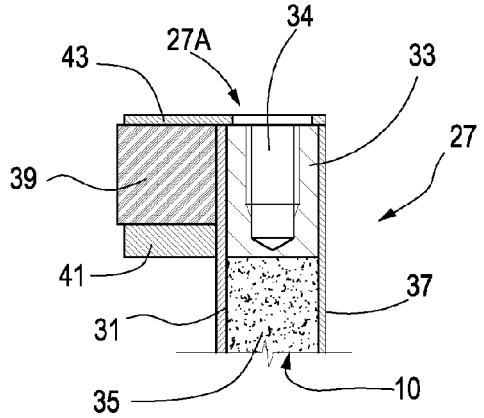
FIGS. 4, 5, 6, and 7 show enlarged cross-sections of the panel of FIG. 3 according to the lines IV-IV, V-V, VI-VI and VII-VII respectively.

Along the outer circumferential edge 27A an insert 33 may be provided, see in particular the detail in FIG. 4. In some embodiments the insert 33, suitably welded to the wall 31, may have a threaded hole 34 for engaging a ringbolt (not shown) for moving and lifting the panel 27.

The bent edges 31A, 31B, 31C delimit the space 10 on a side or face of the wall 31. In some embodiments the space 10 may be provided on the face of the wall 31 that, when the panel mounted, faces the respective head 5, 7. The space 10 may be also provided on the face of the wall that, when the panel is mounted, is opposite the respective head.

The space 10 may be partially or completely filled with a sheet or a plate or a plurality of plates of thermal insulating material 35. The sheets or plates of thermal insulating material 35 may be covered by a respective cover 37 on the outer side of each panel 27. Also the cover 37 may be made of a metal sheet or a polymeric material, such as polycarbonate.

In some embodiments, to better protect the thermal insulating material 35 and especially to prevent it from being damaged due to agents like water or condensate, the cover 37 and the wall 31 are hermetically closed, for instance welded or sealed by means of gaskets, for instance high-temperature silicone gaskets. The closing method chosen depends upon the material forming the components 31 and 37.

Practically, the wall 31, the circumferential edges 31A, 31C thereof, the radial edges 31B thereof and the cover 37 form a shell or case, inside which the thermal insulating material 35 in the form of sheet or plates is contained, preferably glued to the inner surface of the wall 31.

The plates of thermal insulating material 35 may be formed separately and subsequently applied to the respective wall 31. In other embodiments, the plates of thermal insulating material 35 may be produced by pouring a liquid onto the wall 31 and then hardening the thermal insulating material.

The features of the thermal insulating material, described below, may be useful for forming the layer or plate of thermal insulating material 35 described above and illustrated in the figures, as well as for forming insulating panels, plates, layers or the like to be applied on other movable or stationary components, parts of plant or machines, as it will be better apparent from the description below.

In some embodiments, the thermal insulating material may be constituted by a polymeric matrix comprising glass spheres, rock wool and clay or montmorillonite particles.

Advantageously, in some embodiments the glass spheres have a dimension comprised between 5 micrometers and 100 micrometers, for instance between 5 and 60 micrometers, based upon the percent composition of the material.

In some embodiments, the rock wool fibers may have a cross dimension—intended as the maximum dimension of the cross-section—comprised between 2 and 6 micrometers. In case the fibers have a round cross-section, this dimension refers to the diameter. The length of the rock wool fibers may be comprised between 5 and 70 micrometers, depending upon the percent composition of the material.

The numbers above have been given just by way of example and, even if they may be preferred in some embodiments, however they do not limit the scope of the invention.

Generally, the rock wool is an amorphous silicate in the form of thin filaments obtained from siliceous rocks.

The polymeric matrix may contain or be substantially constituted by an acrylic polymer, for instance an acrylic polymer with polar functional groups, to have adhesive features. In some embodiments the acrylic polymer may be an acrylic acid copolymer with acililates and methacrylates with different alkyl chain lengths.

In some embodiments the polymer may be a thermoplastic polymer having a long hydrocarbon chain with polar functional groups.

In some embodiments, phosphor compounds and/or nanostructured clays may be added to the polymeric matrix. The phosphor compound may be chosen among the flame-retardant compounds, for instance an alkyl or aromatic phosphonate.

Clay particles and montmorillonite particles may have nanoscale sizes, in particular comprised between 5 and 100 nanometers, preferably between 5 and 50 nanometers and more preferably between 5 and 20 nanometers, based upon the percent chemical composition.

In some embodiments the insulating material may be produced starting from a composition having a dry percent composition by weight comprising:

glass spheres 5-40% by weight;
rock wool 5-40% by weight;
clay and/or montmorillonite 0.5-5% by weight
polymer, for instance acrylic polymer, 10-40% by weight.

A liquid dispersing agent may be added to this composition, such as water or other agent that can be easily vaporized and has low environmental impact. The function of this dispersing liquid is to adjust the viscosity of the material before distributing it on suitable structures or equipment, to form a layer of material that is then heated and solidified.

For producing the insulating plate a composition of the type described above, in liquid phase, is applied for instance onto a plane support, and subsequently hardened in a furnace. The plate is then cut to measure and applied onto the wall 31 of the single panels forming the insulation structure.

In other embodiments the composition in liquid phase may be directly applied onto the panel, which is then put into a furnace for drying and hardening.

The sheets or plates of thermal insulating material may be formed starting from a suspension, in water or other dispersing liquid, of the polymer and the inorganic components indicated above. The suspension is applied onto a support of suitable shape, according to the final use of the sheet or plate. The layer is then solidified and hardened in a furnace. Once ready, the sheets or plates may be cut or shaped, if necessary, and then applied onto the walls 31 of the single insulation panel 27.

The layer of thermal insulating material 35 applied to the panel 27 may have a thickness comprised between 15 and 30 mm.

In some embodiments, along the outer circumferential edge 27A of the panel 27 a high-temperature gasket 39 may be provided, that rests onto the surface of the head 5, 7 underneath.

The gasket 39, as well as the other gaskets described below with reference to this embodiment and to other embodiments of insulation systems for Yankee cylinders and dryer cylinders, may be made of suitably temperature-resistant and hard silicone materials. Silicones may be for instance used with Shore hardness 70±5 and able to resist peak temperatures in the order of 300° C.

In general, the gasket 39 and the other similar high-temperature gaskets described with reference to the various embodiments have two functions, namely: hermetically sealing the heat radiating parts; and thermally insulating the metal parts of the insulation panels from the metal walls of the mechanism to be insulated (Yankee cylinder, dryer cylinder, air hood, etc.), to avoid or reduce the problems resulting from thermal expansion.

In advantageous embodiments the gasket 39, which may have an annular extension, may be housed between an annular segment 41 fixed to the surface facing the inside of the wall 31 and an outer annular segment 43 fixed along the outer circumferential edge 27A of the panel 27 extending around the frame 33 and outside thereof (see FIG. 4).

In some embodiments, a holed disk 45 is provided in an approximately central area, preferably on the centerline plane of the panel 27, adjacent to the inner circumferential edge 27B; the disk is housed inside the space 10 delimited by the wall 31 and the edges thereof and is welded thereto. The holed disk 45 has a through axial hole 47 for a locking screw used to fasten the insulation panel 27 to a mounting ring 49 that is fixed to the support and rotation journal 15, 17 of the respective head 5, 7.

Figure 8:
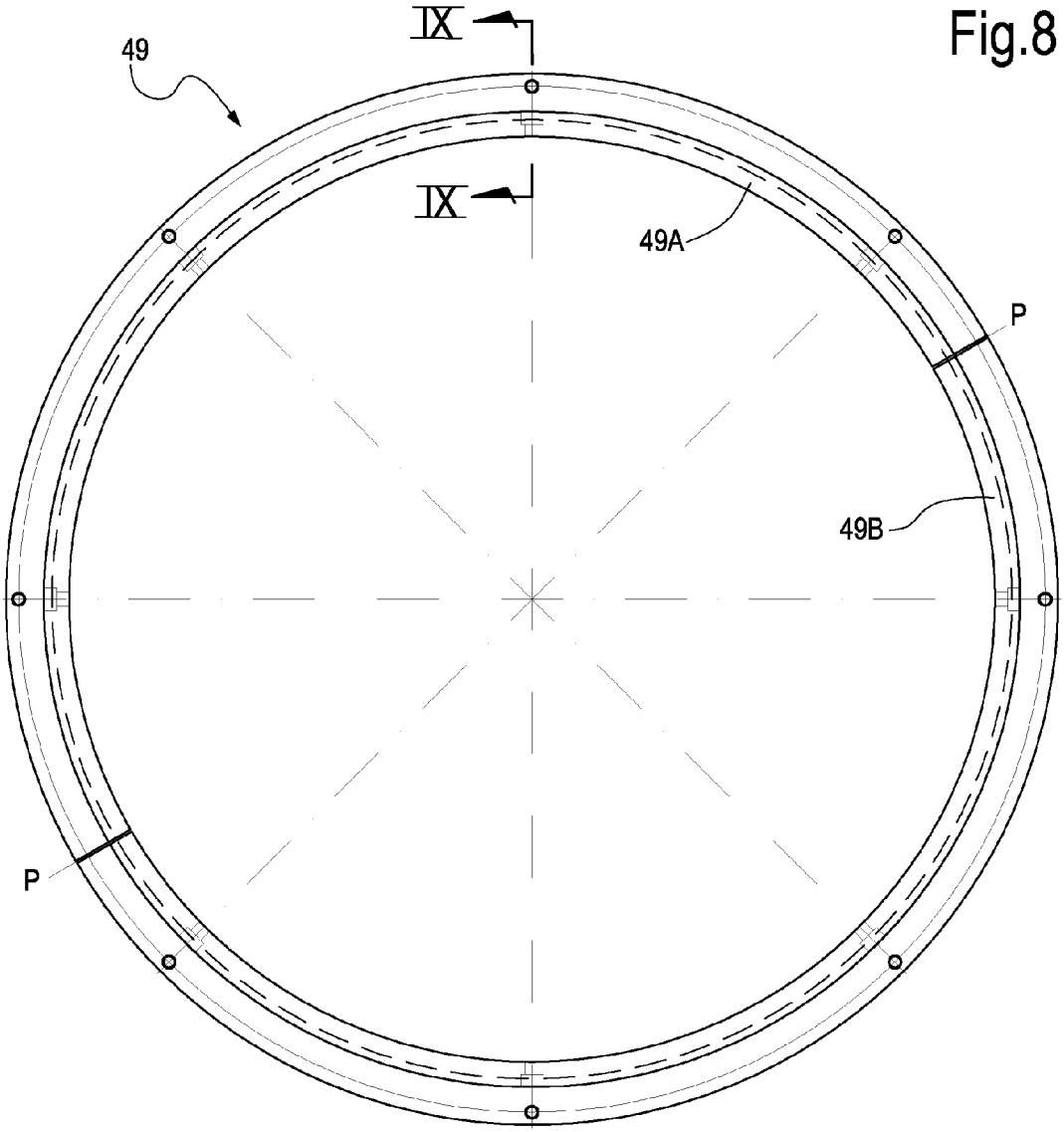
FIG. 8 is a front view of a mounting ring fixed onto one support and rotation journal of the Yankee cylinder.

The mounting ring 49 may be comprised of a plurality of portions, for instance two portions indicated with 49A and 49B in the front view of FIG. 8 showing the mounting ring 49 separately from the other components of the Yankee cylinder and the insulation system. P-P indicates the plane dividing the two semi-annular portions 49A, 49B into which (in this example of embodiment) the mounting ring 49 is subdivided.

The mounting ring may be also comprised of more than two portions.

In some embodiments the two semi-annular portions 49A, 49B of the mounting ring 49 may be welded together once the ring has been mounted around the respective support and rotation journal 15, 17 of the Yankee cylinder 1.

In advantageous embodiments the two semi-annular portions 49A, 49B of the mounting ring 49 may be fastened to the respective support and rotation journal 15, 17 by means of screws 51 (see in particular the detail of FIG. 1B) that are inserted into holes 49C (FIG. 9) of the ring 49.

In some embodiments, the ring 49 may be provided with an annular groove 49D, delimited by two annular projections 49E, 49F projecting radially from the mounting ring 49.

Once the ring has been mounted (see FIG. 1B), the groove 49D receives the inner circumferential edge 27B of each insulation panel 27. The holed disk 45 of each insulation panel 27 is arranged with the hole 47 thereof in correspondence of two opposite holes 49G and 49H provided on the annular projections 49E, 49F of the mounting ring 49. The hole 49G may be a smooth through hole, whilst the hole 49H may be threaded. In this way (FIG. 1B) each insulation panel 27 may be fixed by means of a through screw 55 that extends across the hole 49G and the through hole 47 of the disk 45 and is screwed in the threaded hole 49H of the mounting ring 49.

In this way each insulation panel 27 may be fastened, near its own inner circumferential edge 27B, to the structure of the head 5, 7 of the Yankee cylinder 1.

In some embodiments, a high-temperature gasket 57 may be interposed between the inner surfaces of the groove 49D and the insulation panel 27.

The insulation panels 27 may be fastened, near their outer circumferential edges 27A, to the respective head 5, 7 by means of fastening brackets or clamps 59, shown in particular in the enlargements of FIGS. 2B and 2C.

Each bracket 59 may be provided with a pair of screws 60 engaging the respective head 5, 7 in corresponding threaded holes provided in the head. The screws 60 pass across through holes 59A provided in the bracket 59.

In advantageous embodiments each bracket 59 has a sufficient length, in circumferential direction, to block two adjacent insulation panels 27 in correspondence of corresponding angles, each bracket 59 being applied in correspondence of two adjacent radial edges 27C of two consecutive insulation panels 27, as it is shown in particular in FIG. 2C.

In this way, each panel is fixed along the respective outer circumferential edge 27A by means of two brackets 59.

Figure 1A:
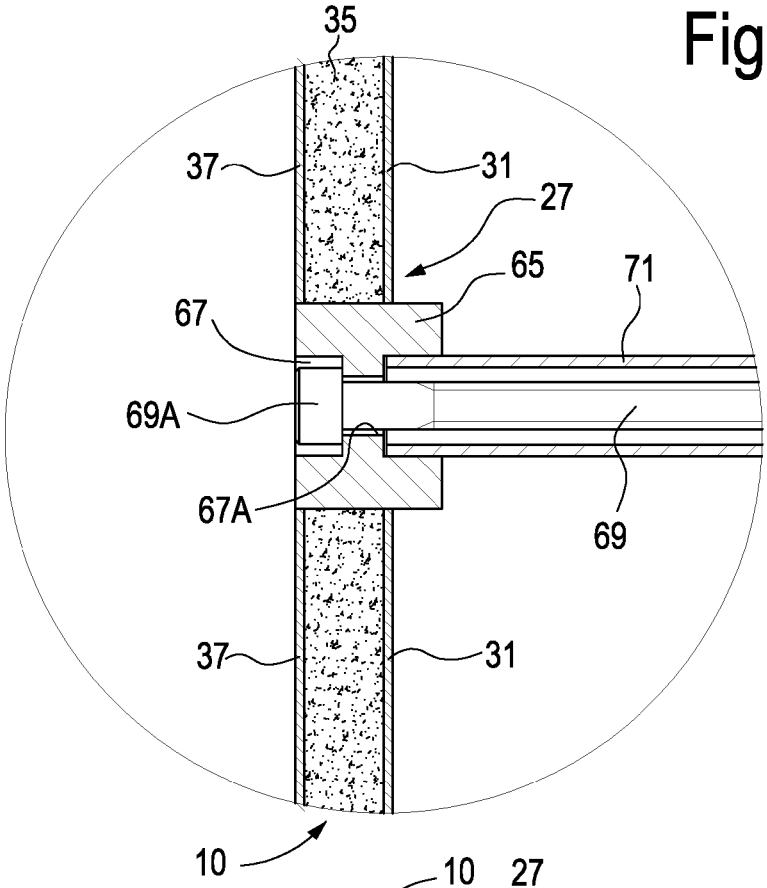
FIGS. 1A and 1B show enlargements of the details $I_A$ and $I_B$ of FIG. 1.
Figure 1B:
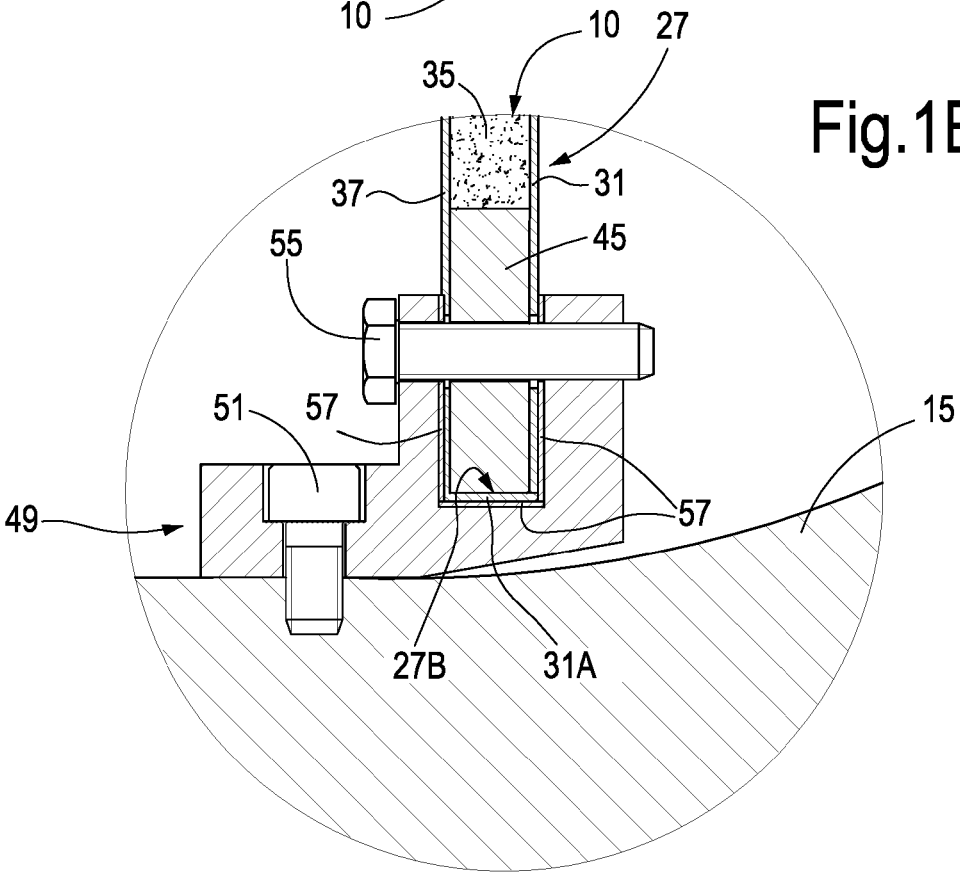
Figure 5:
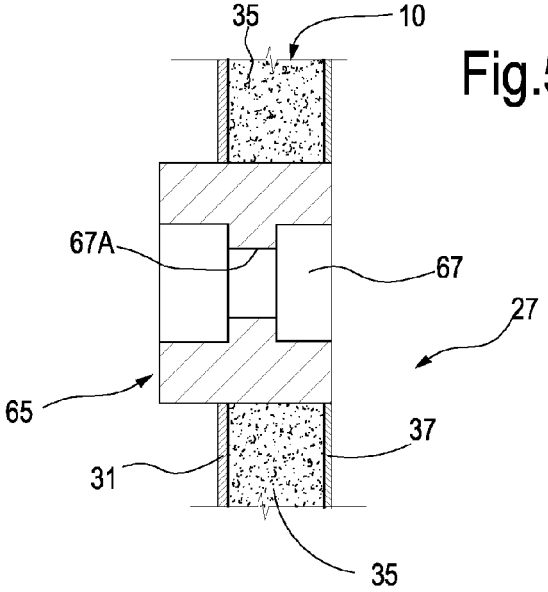
Figure 7:
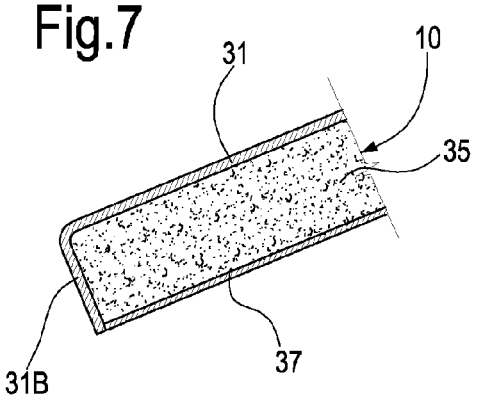
Figure 6:
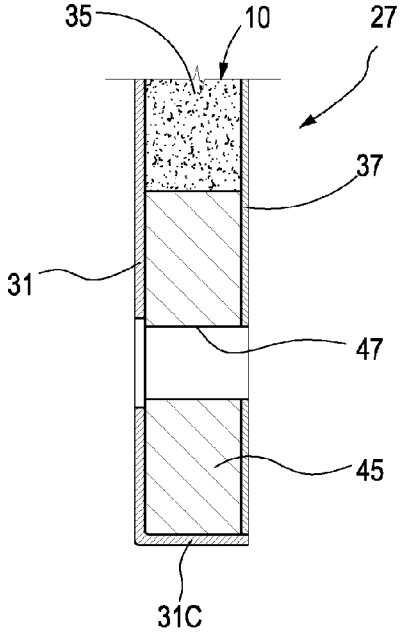

In some embodiments, each insulation panel 27 has one or more intermediate fastening points between the outer circumferential edge 27A and the inner circumferential edge 27B. In the illustrated embodiment, each panel 27 has three intermediate fastening points, indicated with 61, aligned on a circumference whose radius is intermediate between the radius of the outer circumferential edge 27A and of the inner circumferential edge 27B. FIG. 5 shows an enlargement of the fastening area of one intermediate fastening point of the panel 27, and FIG. 1A shows an enlargement of the mounted intermediate fastening system.

In some embodiments, a bushing 65 is arranged in correspondence of each fastening point 61, the bushing having a through hole 67 with double diameter, i.e. provided with an inner annular projection 67A.

The panel 27 is fastened at the intermediate fastening point 61 by means of a respective screw 69, whose head 69A rests on the inner projection 67A and which passes across the through hole 67 engaging a threaded hole provided in the respective head 5 or 7.

In some embodiments, each screw 69 may be surrounded by a tube 71 fixed in the through hole 67 of the respective bushing 65, acting as a spacer for the panel 27 with respect to the head 5, 7.

Figure 10:
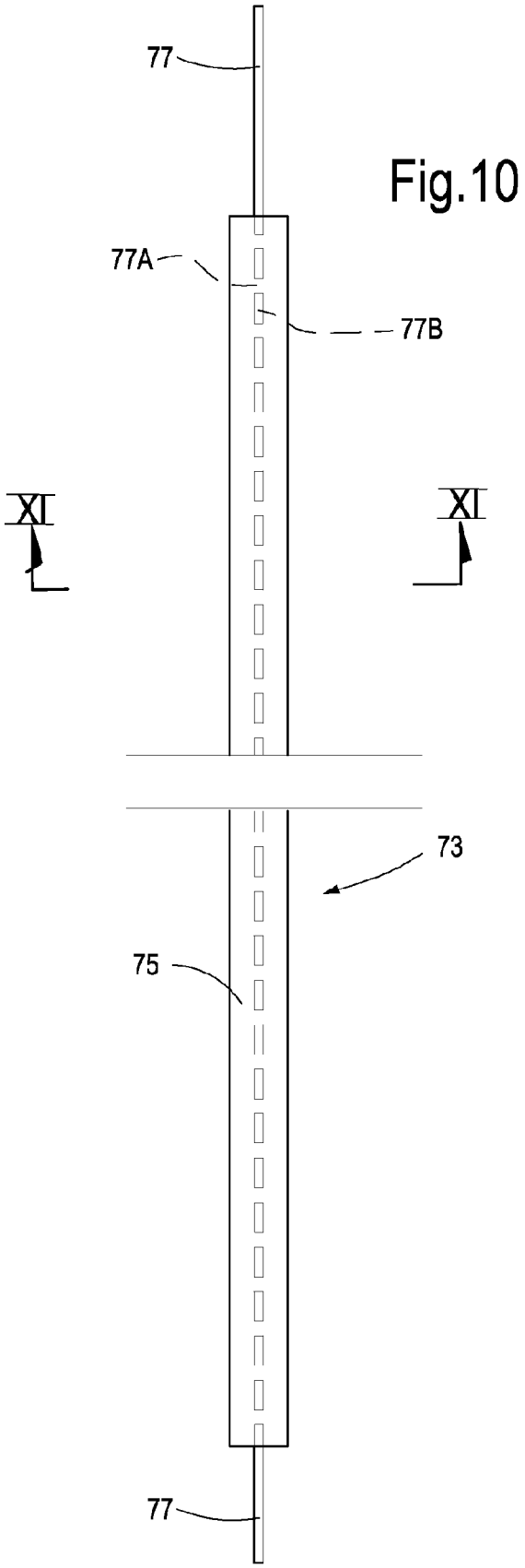
FIG. 10 is a front view of a rod for balancing clearances between adjacent insulation panels.
Figure 11:
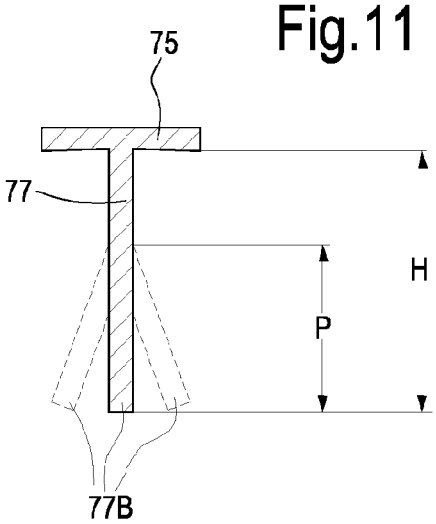
FIG. 11 is a cross-section according to IX-IX of FIG. 10.

To compensate for any clearance between adjacent panels 27, a rod 73 may be inserted between the opposite radial edges 27C of each pair of consecutive insulation panels 27; this rod is shown separately in FIGS. 10 and 11. In some embodiments, the rod 73 has a substantially T-shaped cross-section (FIG. 11). The rod 73 may have a wing 75 extending at least partially along the longitudinal extension of the same rod 73 and forming the horizontal part of the T-shaped section. A web 77 extends from the wing 75 and orthogonally to it; the longitudinal length of the web may be greater than the length of the wing 75. The portion of the web 77 projecting from the wing 75 engages below the fastening brackets or clamps 59 to fix the rod to the Yankee cylinder.

The web 77 may be interrupted by means of transverse cuts 77A subdividing the web 77 into single appendages 77B. The transverse cuts 77A may have a depth p (FIG. 11) equal to more than half the height H of the web 77. This latter has anyway a portion, whose height is (H-p), along which there are no cuts. The single appendages 77B may be displaced towards the outside, therefore out of a median plane of the rod 73, as schematically shown in FIG. 11. When mounted, the rod 73 is inserted with the web 77 thereof between two consecutive insulation panels 27, so that the wing 75 of the rod 73 covers the joint formed by the two substantially rectilinear radial edges 27A of the two consecutive insulation panels 27. Moving the appendages 77B apart, as shown in broken line in FIG. 11, the clearance between adjacent insulation panels 27 may be compensated. Practically, this balance is made before the panel 27 is fixed to the respective head of the Yankee cylinder.

Insulation of a Yankee Cylinder (Figures from 12 to 19)

Figures from 12 to 19 show a further embodiment of a Yankee cylinder, provided with an insulation according to the invention.

The same reference numbers indicate equal or equivalent parts to those described with reference to the embodiment of figures from 1 to 11. The Yankee cylinder, again indicated as a whole with number 1, comprises a cylindrical shell 3 and heads 5, 7, with which support and rotation journals 15 and 17 are associated, provided with bearings 19 and 21, for instance ball or roller bearings.

Insulation systems 23 and 25 are associated with the heads 5 and 7; they are substantially flat in this embodiment.

The two insulations 23 and 25 may be substantially symmetrical, and only one of them will be described below with particular reference to those elements thereof that are different from those of the insulation already described with reference to FIGS. 1 to 11.

Each insulation 23, 25 has panels 27 arranged like an annulus, where each panel is a segment of the annulus.

Figure 15:
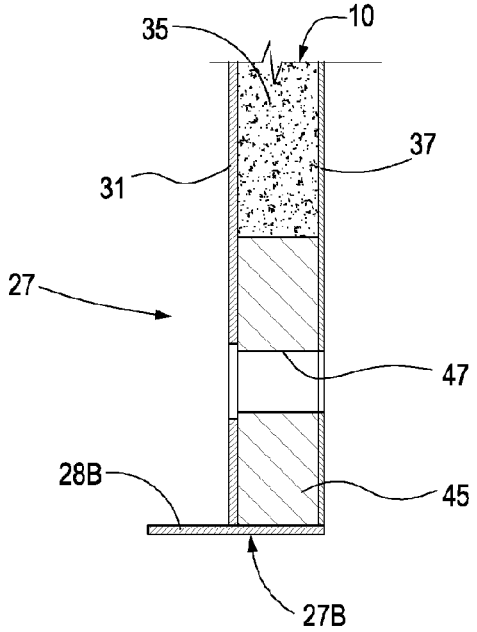
FIGS. 15, 16, and 17 show cross-sections according to XV-XV, XVI-XVI and XVII-XVII of FIG. 14, respectively.
Figure 16:
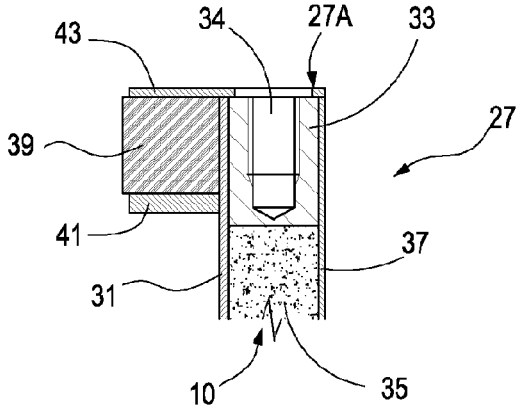
Figure 17:
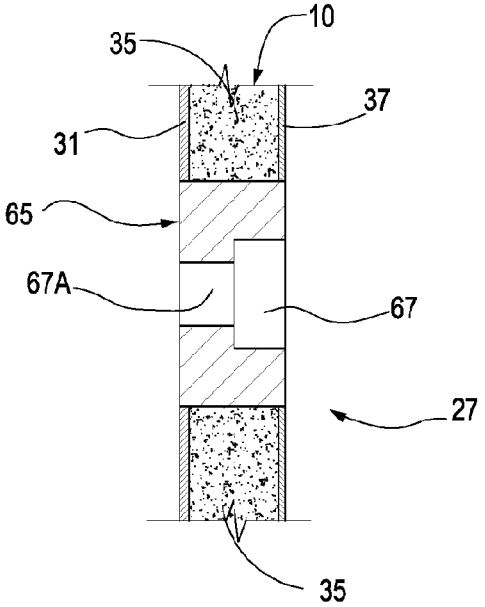

Similarly to what already described with reference to FIGS. 1 to 11, each panel 27 may have a wall 31 (see in particular FIG. 15) made for instance of metal sheet. Advantageously, the panel 27 may have an outer circumferential edge 27A, an inner circumferential edge 27B and two substantially rectilinear radial edges 27C converging from the outside towards the inside.

Advantageously, a cover 37 extends parallel to the wall 31. The thermal insulating material 35 in the form of sheet or plate is arranged in the inner space 10 delimited between the wall 31 and the cover 37. The composition of the material 35 may be of the type already described above with reference to the embodiment of FIGS. 1 to 11. The insulating material may be applied in liquid phase onto the wall 31 and then hardened, for instance in a furnace. Preferably, as already disclosed with reference to the embodiment described above, the plate or sheet is formed by distributing a fluid suspension containing a dispersing agent, which is then solidified and hardened in a furnace. In other embodiments the plate or sheet is formed separately from the wall 31, for instance onto a suitable support surface, and can have dimensions greater than those necessary to fill the insulation panel 27. The plate may then be cut to measure and applied onto the wall 31, for instance by gluing.

On the perimeter, the wall 31 may have bent edges to laterally delimit the space 10 inside which the plate 35 is housed as described above with reference to the embodiment of FIGS. 1 to 11.

Each panel 27 may have, along the inner circumferential edge 27B, in a approximately central position, a holed disk 45; number 47 indicates the through hole of the disk, inside which a locking screw is inserted as described below.

In some embodiments, along the inner circumferential edge 27B of each panel 27 an annular band 28B may be provided, for instance of metal sheet, that may be welded to the sheet metal forming the wall 31. The annular band 28B may project from the wall 31 of the respective insulation panel 27 towards the respective head 5, 7.

Similarly to what already described with reference to FIGS. 1 to 11, in the area of the outer circumferential edge 27A the panel 27 may have a frame 33 provided with a threaded hole 34 in an approximately central position for engaging a ringbolt or other member for moving and lifting the panel 27.

In advantageous embodiments, in correspondence of the outer circumferential edge 27A, the panel 27 has annular bands or segments 41, 43, between which a gasket 39 is housed. The gasket 39 and the annular segments 41 and 43 project from the support wall 31 for the insulating material 35 towards the respective head.

In an intermediate position the panel 27 may have a bushing 65, substantially similar to the bushing 65 of the previous embodiment, with a through hole 67 of variable diameter forming an inner projection 67A acting as an abutment for screws for blocking the panel 27 in an intermediate position between the inner circumferential edge 27B and the outer circumferential edge 27A, in correspondence of the intermediate fastening points where the respective panel is fixed to the corresponding head.

Figure 18:
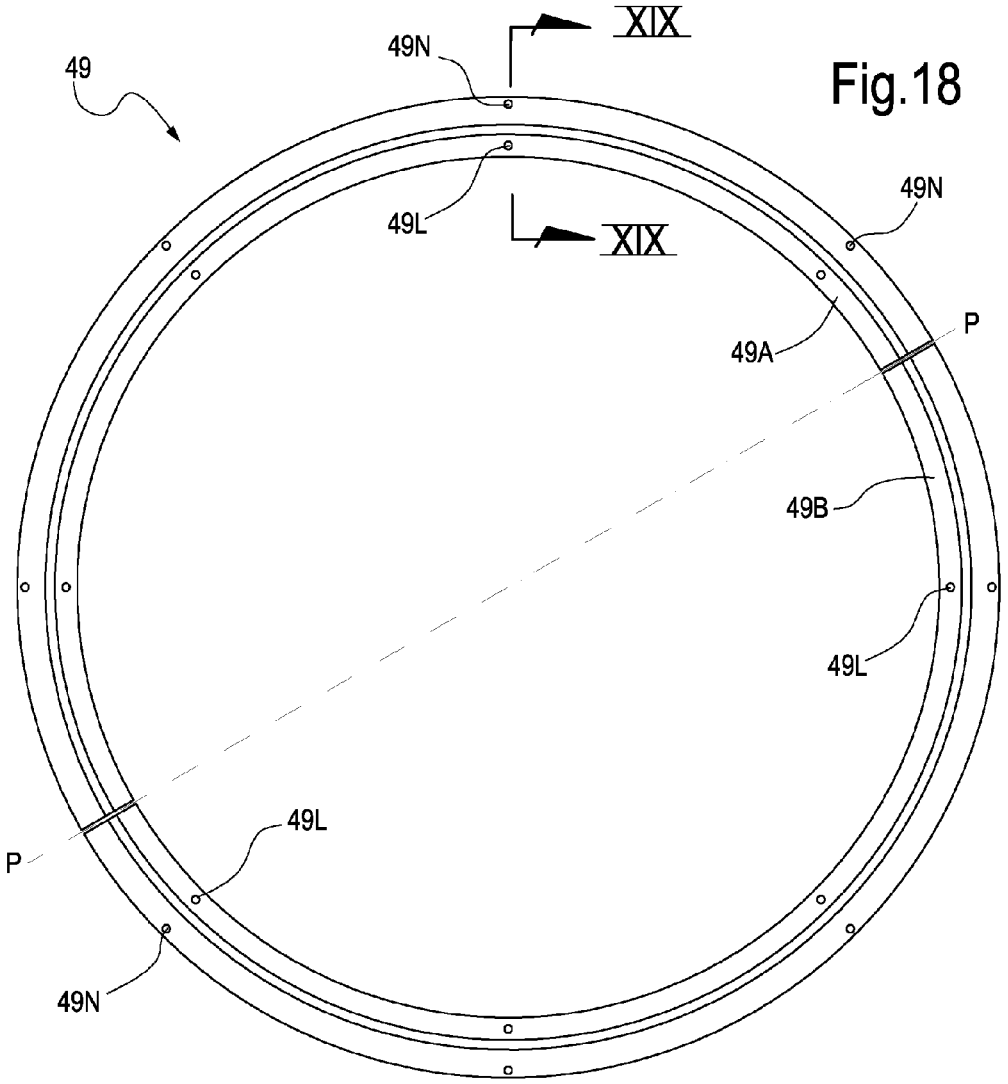
FIG. 18 is a front view of the mounting ring of the insulation of FIGS. 12 and 13.
Figure 19:
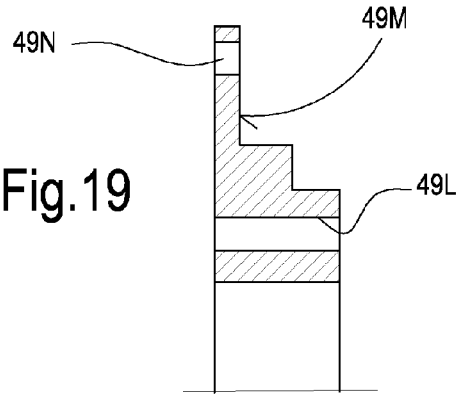
FIG. 19 is a cross-section according to the line IXX-IXX of FIG. 18.

In this embodiment again, for fastening the panels 27 to the heads 5, 7 a mounting ring is provided in correspondence of the inner circumferential edges 27B; the ring is indicated as a whole with number 49 and is shown separately in FIG. 18. In some embodiments the mounting ring 49 may be subdivided into two semi-rings 49A and 49B, joined along a diameter plane P-P, see FIG. 18.

Figure 9:
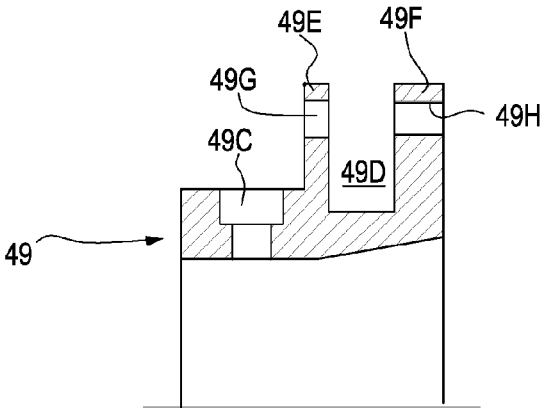
FIG. 9 is an enlarged cross-section according to IX-IX of FIG. 8.

The mounting ring 49 may be provided with through holes 49L for locking screws fastening the ring 49 to the head 5,7. In this embodiment, the holes for the locking screws are directed parallel to the axis of rotation of the Yankee cylinder, and not orthogonally to it as occurs for the holes 49C of the previous embodiment (FIG. 9).

The mounting ring 49 may extend radially towards the outside with respect to the diameter onto which the holes 49L are located, forming a flange 49M with through holes 49N for locking screws for the panels 27.

Figure 12:
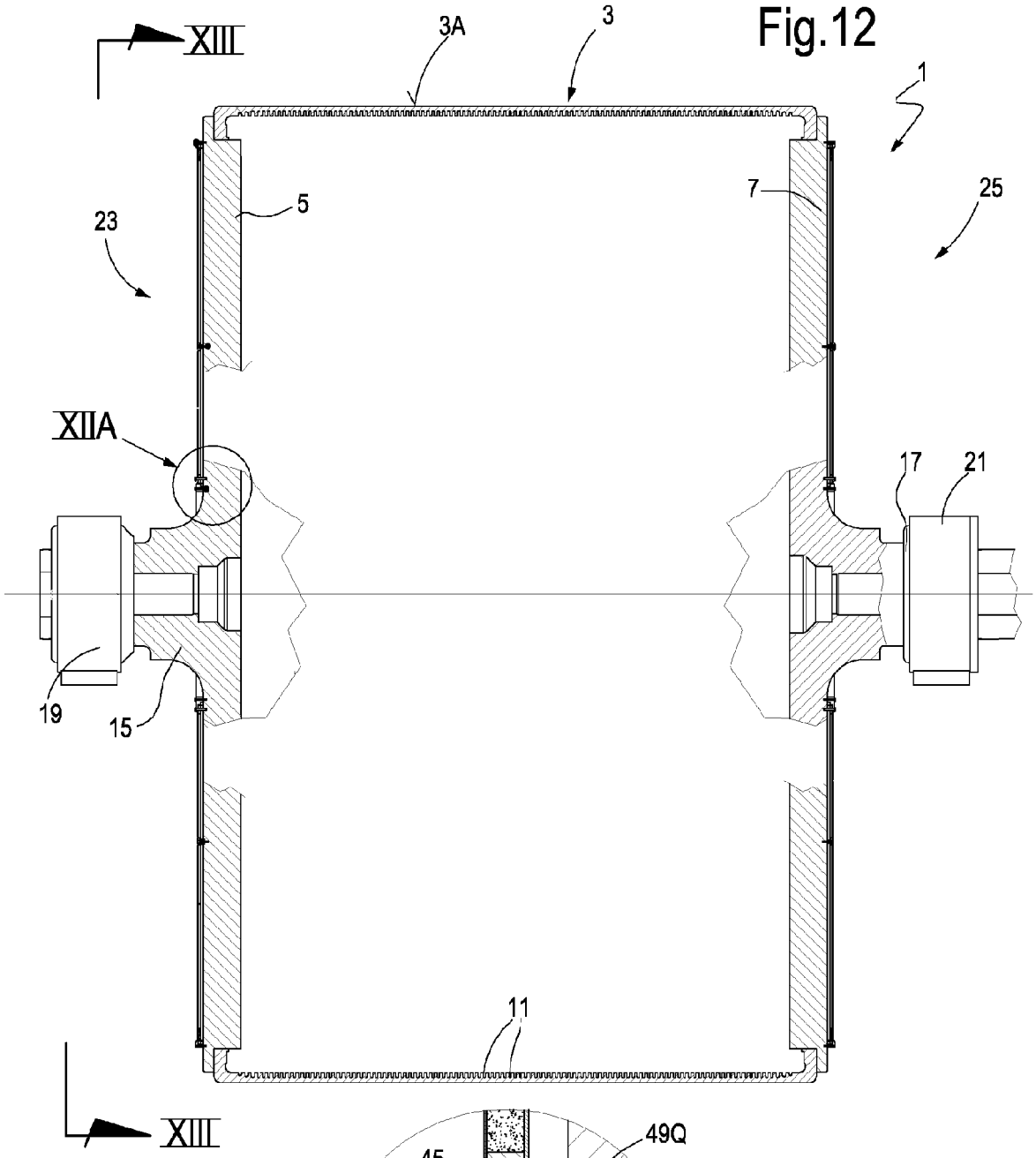
FIG. 12 is a cross-section, according to a longitudinal plane passing through the axis of rotation, of a Yankee cylinder with an insulation system according to a further embodiment.
Figure 12A:
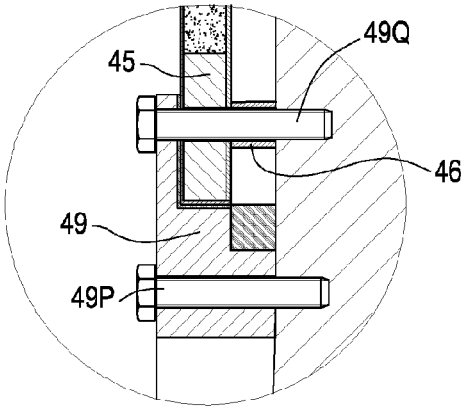
FIG. 12A shows an enlargement of the detail indicated with $XII_A$ in FIG. 12.

The mounting ring 49 is shown in detail in FIG. 12A, mounted on the Yankee cylinder 1. Screws 49P fasten the mounting ring 49 to the respective head 5, 7 and screws 49Q pass through the respective holed disks 45 and engage threaded holes provided in the respective head. Each screw 49P may be associated with a spacer 46.

The intermediate area of each panel 27 is fixed by means of through screws 69 (FIG. 13B) extending through the respective bushings 65 arranged in an intermediate position along the radial extension of each panel 27. A spacer 66 is advantageously provided between the surface of the head 5 facing the insulation panel 27 and the bushing 65.

The insulation panels 27 are fixed along the outer circumferential edges 27A, in a manner substantially similar to that already described with reference to the embodiment of FIGS. 1 to 11, by means of brackets or clamps 59 and screws 60, as shown in particular in the detail of FIG. 13C.

Figure 13:
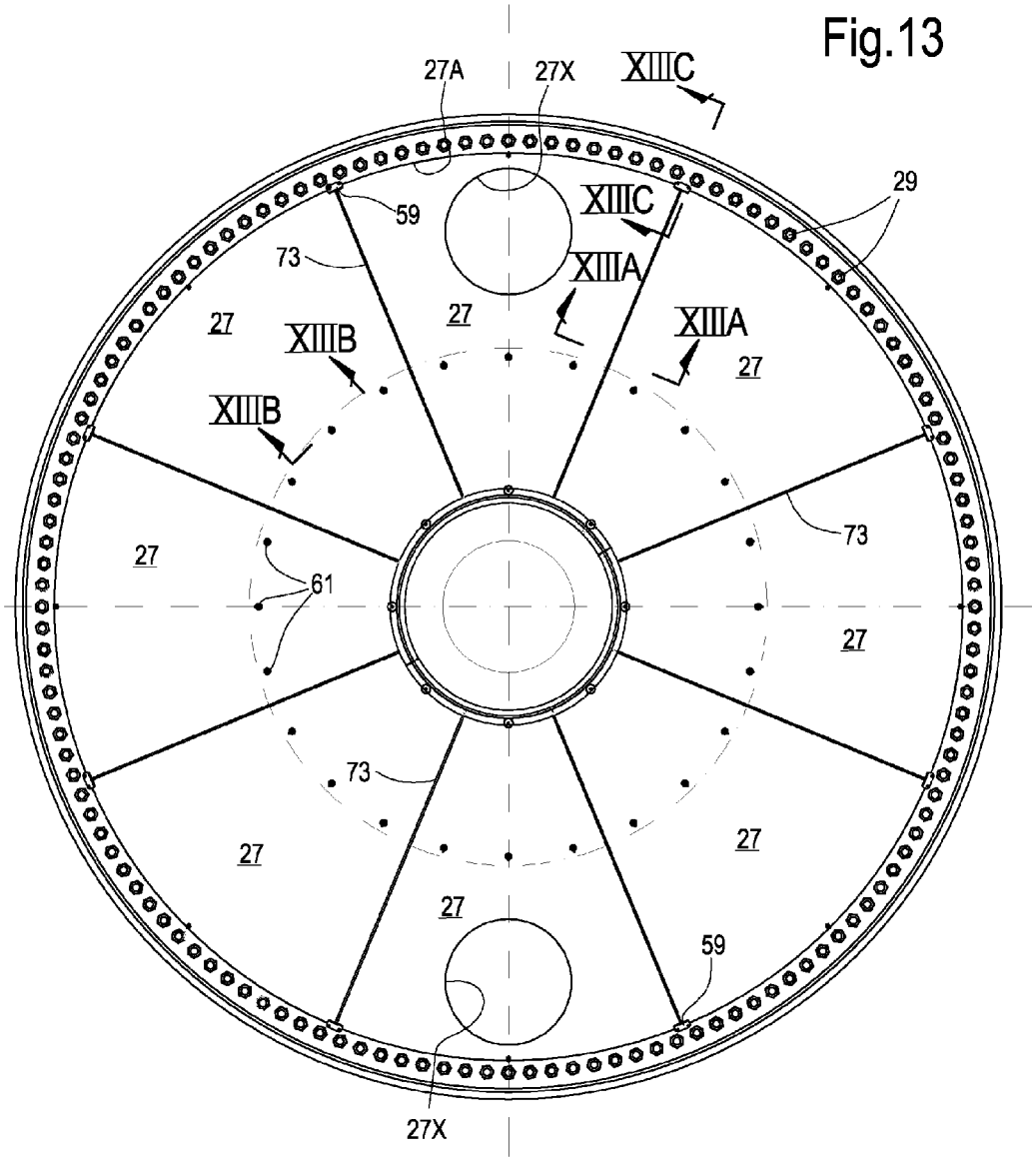
FIG. 13 is a front view according to XIII-XIII of FIG. 12.
Figure 13A:
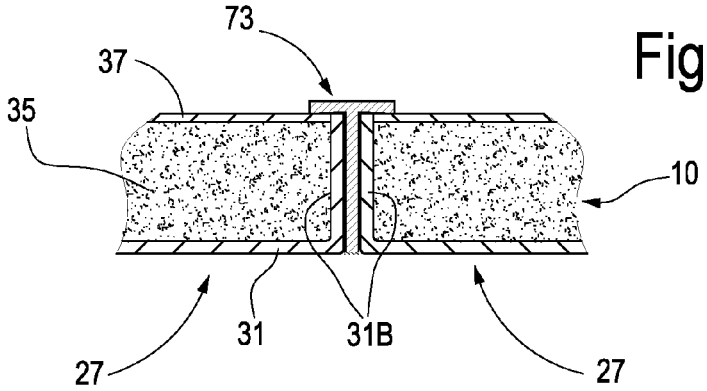
FIGS. 13A, 13B, and 13C are cross-sections according to the lines $XIII_A$-$XIII_A$, $XIII_B$-$XIII_B$, $XIII_C$-$XII_C$, of FIG. 13, respectively.
Figure 13B:
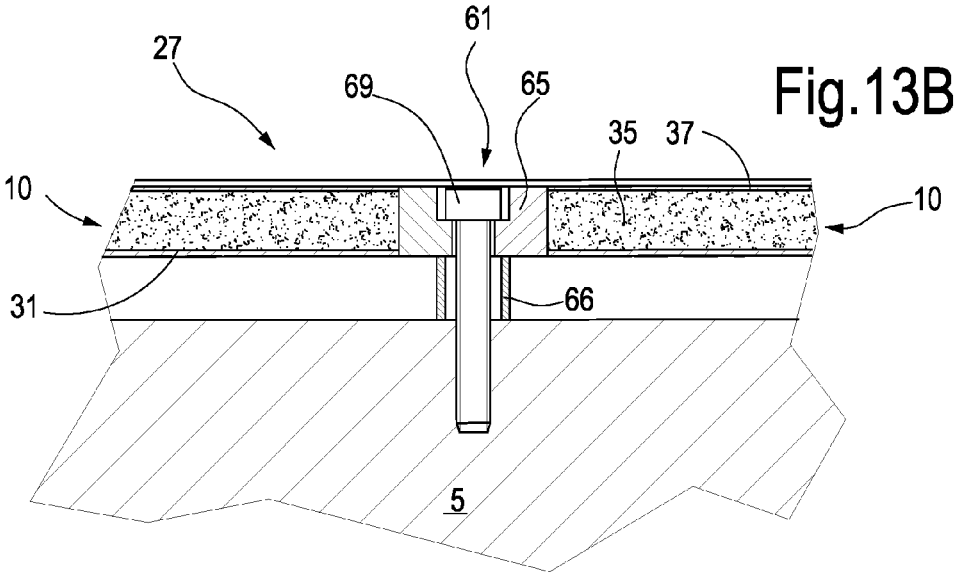
Figure 13C:
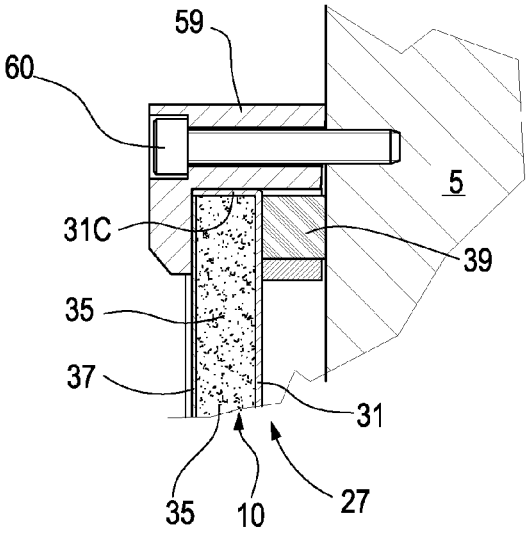
Figure 14:
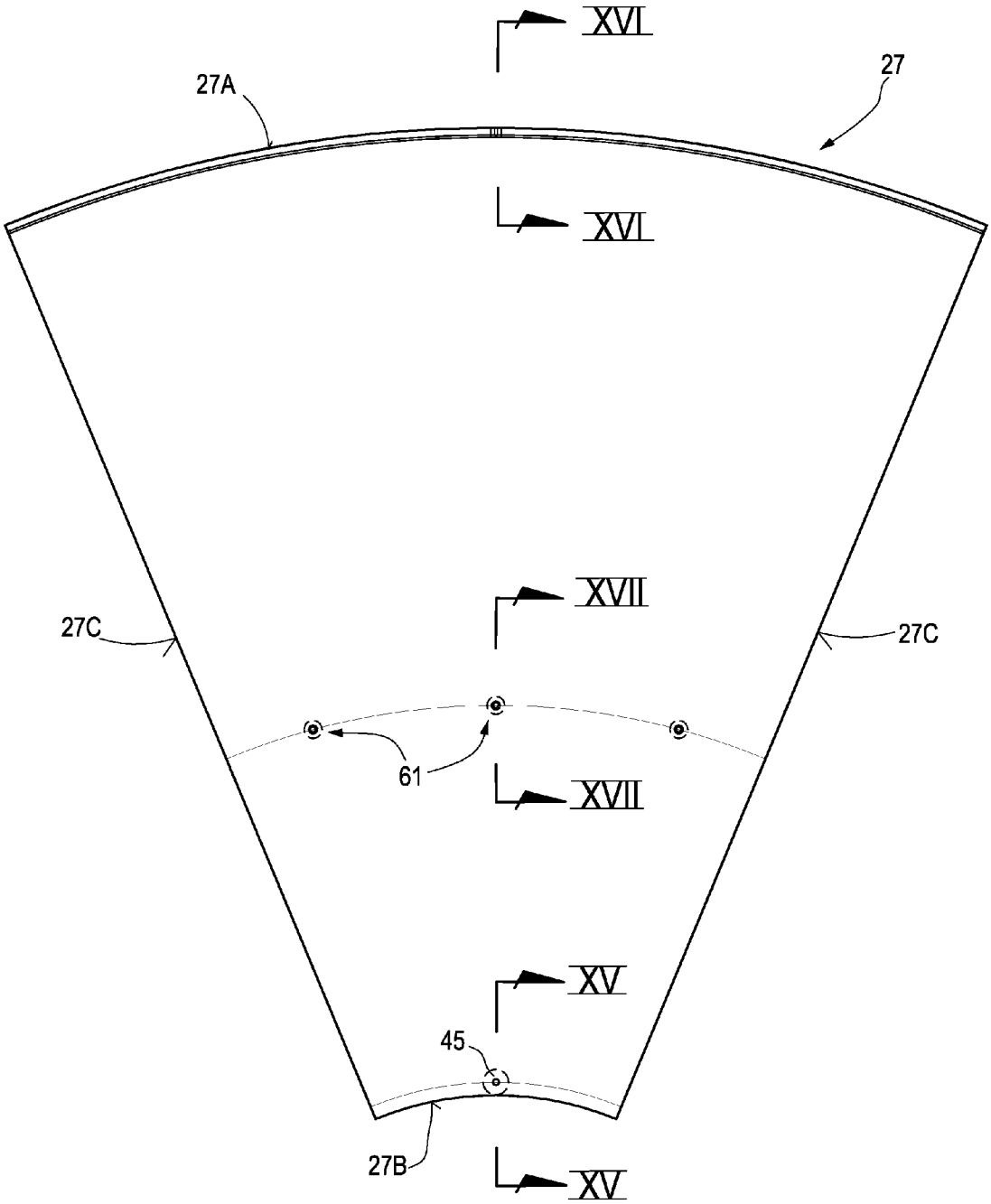
FIG. 14 shows separately an insulation panel of the insulation system of FIGS. 12 and 13.

As shown in the enlargement of FIG. 13A, in this embodiment again a rod 73 is applied between adjacent panels 27 and more in particular in the joint or space defined between the opposite radial edges 27C of two adjacent panels 27; this rod has a substantially equal conformation to that described with reference to FIGS. 10 and 11 and has similar functions.

Figures 20, 20A, 20B:
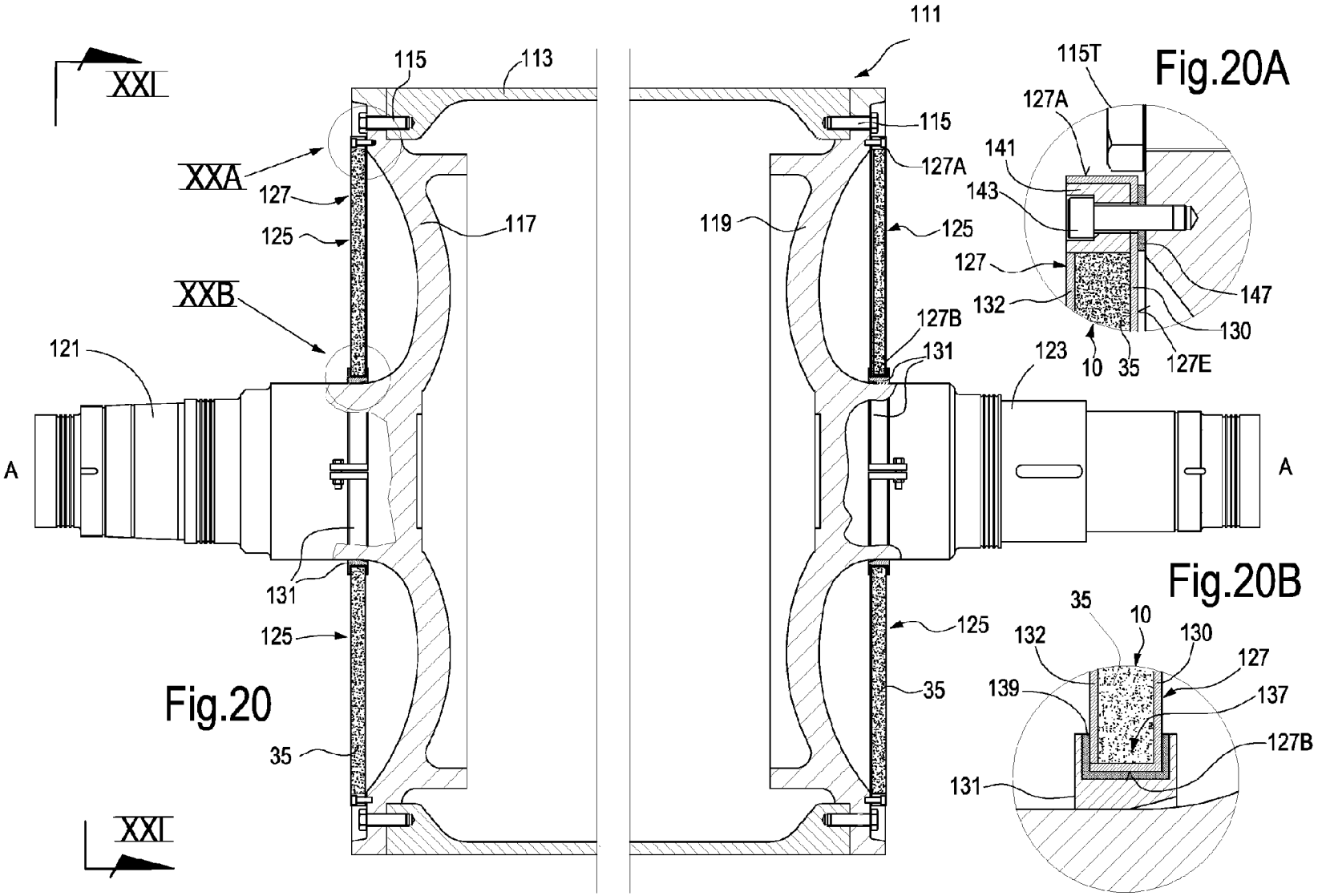
FIG. 20 is a cross-section, according to a longitudinal plane containing the axis of rotation, of a dryer cylinder with an insulation system according to the invention.
FIGS. 20A and 20B show enlargements of the details $XX_A$ and $XX_B$ of FIG. 20, respectively.
Figure 21:
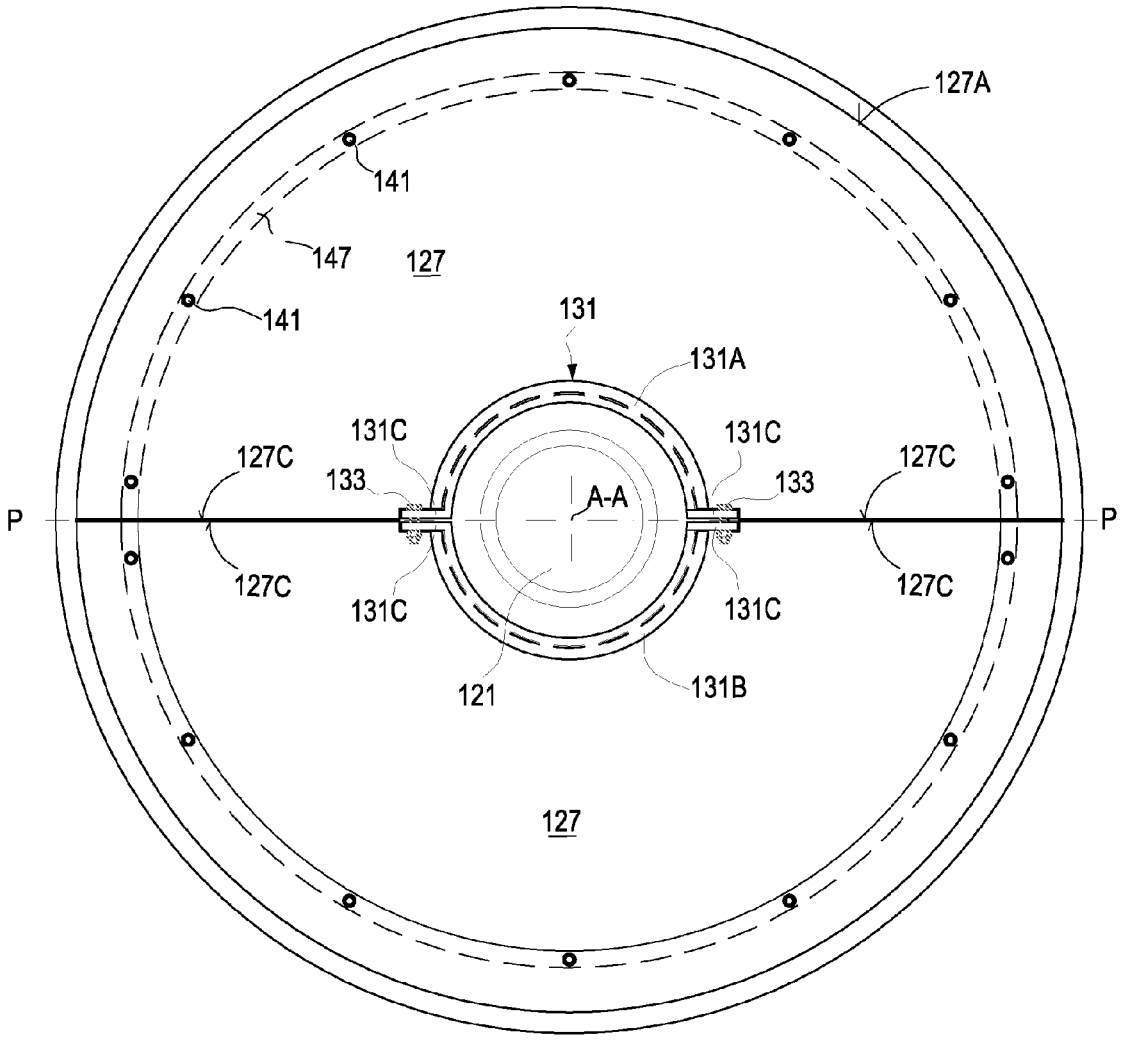
FIG. 21 is a front view according to XXI-XXI of FIG. 20.

Insulation of a Dryer Cylinder (FIGS. 20 and 21)

FIGS. 20 and 21 show an embodiment of a dryer cylinder provided with a thermal insulation according to the invention. The dryer cylinder is indicated as a whole with number 111.

In some embodiments, the dryer cylinder 111 has a shell 113 fixed at the circumference to heads 117, 119, for instance by means of screws 115. With a configuration similar to that of a Yankee cylinder, the dryer cylinder 111 is advantageously provided with support and rotation journals 121, 123 that can be fastened to the heads 117, 119 or produced in a single piece with them. Number 110 indicates the hollow interior of the dryer cylinder 111.

In advantageous embodiments, thermal insulations indicated as a whole with 125 are fixed on the two heads 117, 119. The two insulations 125 of the two heads may be symmetrical and only one of them will be therefore described below.

In some embodiments, as it is shown in particular in FIG. 21, the insulation system is comprised of a plurality of panels 127. In the illustrated example two semi-annular panels 127 are provided, lying on a common plane and arranged adjacent to one another along a plane P-P. In other embodiments, more than two insulation panels 127 may be provided, each of which extending for less than 180°.

Each semi-annular insulation panel 127 has an outer circumferential edge 127A and an inner circumferential edge 127B (see in particular FIG. 20B). Each insulation panel 127 may have adjacent preferably rectilinear radial edges 127C.

In some embodiments, the insulation panel 127 may be integrally formed by a sheet or plate of thermal insulating material. In other embodiments, a plate of thermal insulating material may be mounted onto a support mounting wall, made for instance of metal sheet, substantially in the same manner as described above with reference to the panels 27 and the layers of insulating material 35 applied thereon. For instance, as shown in the enlargements of FIGS. 20A, 20B, each panel 127 comprises a shell or case formed by a wall 130 with bent edges forming a containing space 10, similarly to the wall 31, and a cover 132 similar to the cover 37 of the embodiments described above. The cover 132 and the wall 130 may be hermetically closed, for instance welded or sealed together by means of a high-temperature resistant sealing agent. Inside them the thermal insulating material, is arranged indicated again with number 35 as in the previous embodiments; this material may be formed by plates or by a sheet, preferably solidified and hardened in a furnace and then glued for instance on the inner surface of the wall 130.

In this case again, the thickness of the thermal insulating material 35 in the form of plates or sheet may be comprised between 15 and 30 mm.

In some embodiments, the inner circumferential edge 127B of the panels 127 is fixed to the respective journal 121, 123 by means of a mounting ring 131.

In some embodiments, the mounting ring 131 may be comprised of two halves, indicated with 131A and 131B in FIG. 21. The two halves of the mounting ring 131 may be clamped together by means of screws and bolts 133 that engage appendices 131C provided at the two ends of each semi-ring 131A, 131B.

As shown in particular in FIG. 20, the mounting ring 131 may have an annular groove 137, inside which the inner circumferential edge 127B of each insulation panel 127 is inserted. In some embodiments, a high-temperature gasket 139 may be arranged between the surface of the insulation panel 127 and the inner surfaces of the annular groove 137.

Along the outer circumferential edge 127A of each insulation panel 127 a lowered annular seat 127D may be provided, where the heads 115T of the screws or bolts 115, for fastening the respective head to the shell 113, are housed.

Holes 141 may be provided in radially inner positions with respect to the annular seat 127D; through these holes, screws 143 pass, arranged in a circumferential fashion around the axis of rotation A-A of the dryer cylinder 111 near the outer circumferential edge 127A of the insulation panels 127. The insulation panels 127 are fastened near their outer circumferential edges 127A, by means of the screws 143, engaging threaded holes 145 provided on the respective heads 117, 119.

In some embodiments, a high-temperature gasket 147 may be provided between the outer surface of the respective head 117, 119 and the inner surface 127E, i.e. the surface facing the head, of each insulation panel 127. The gasket 147 may extend in annular fashion along the area where there are arranged the screws 143.

Insulation of a Yankee Cylinder (Figures from 22 to 35)

In FIGS. 22 to 35 a further embodiment is shown of a thermal insulation according to the invention, associated with a Yankee cylinder, used in the wet production plants for producing cellulose plies, for instance paper, tissue paper, cardboard or the like. The same numbers indicate identical or equivalent parts to those of FIGS. 1 to 11 and of FIGS. 12 to 19 described above.

Figure 22:
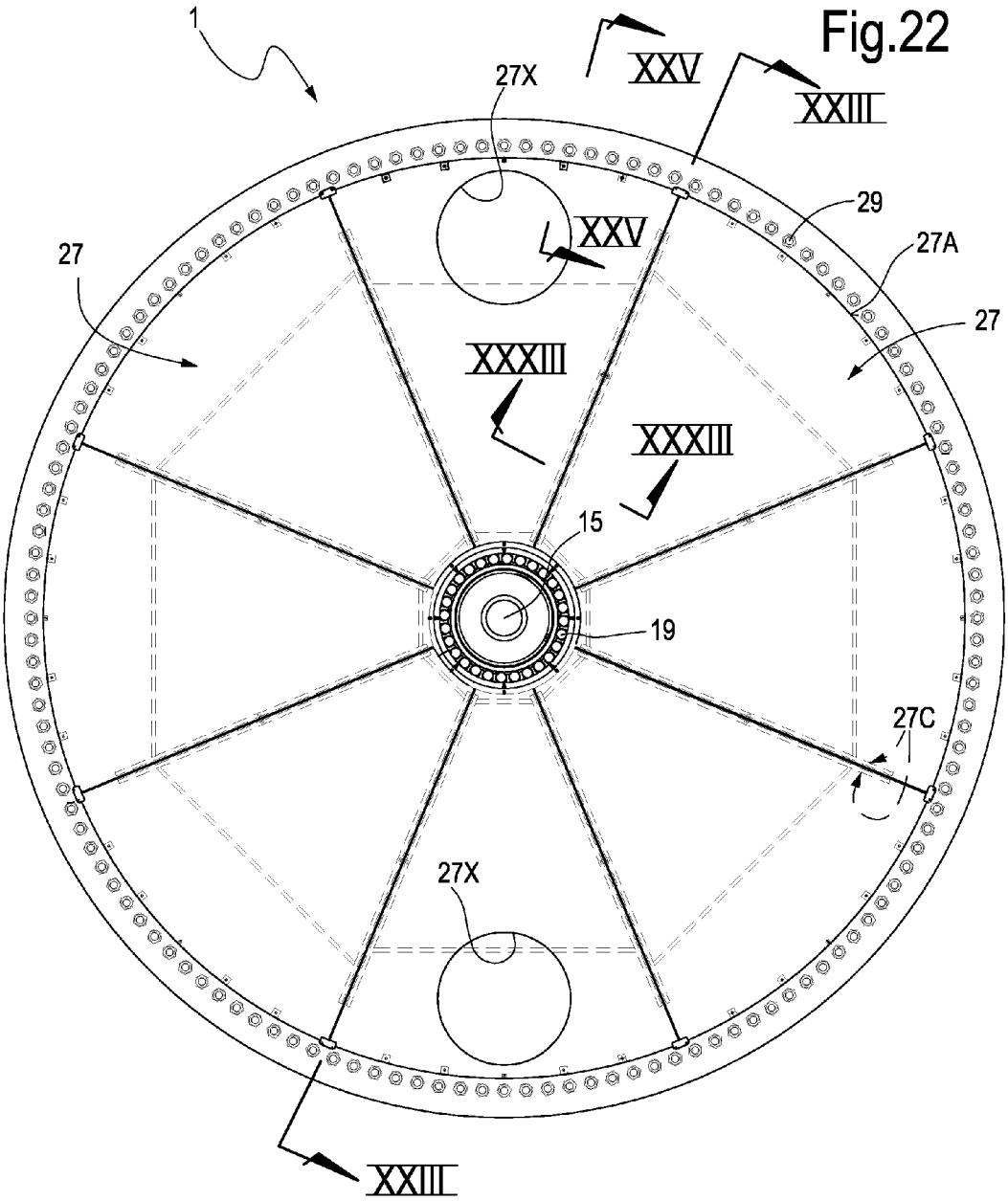
FIG. 22 is a front view of a Yankee cylinder with the insulation in a further embodiment.
Figure 23:
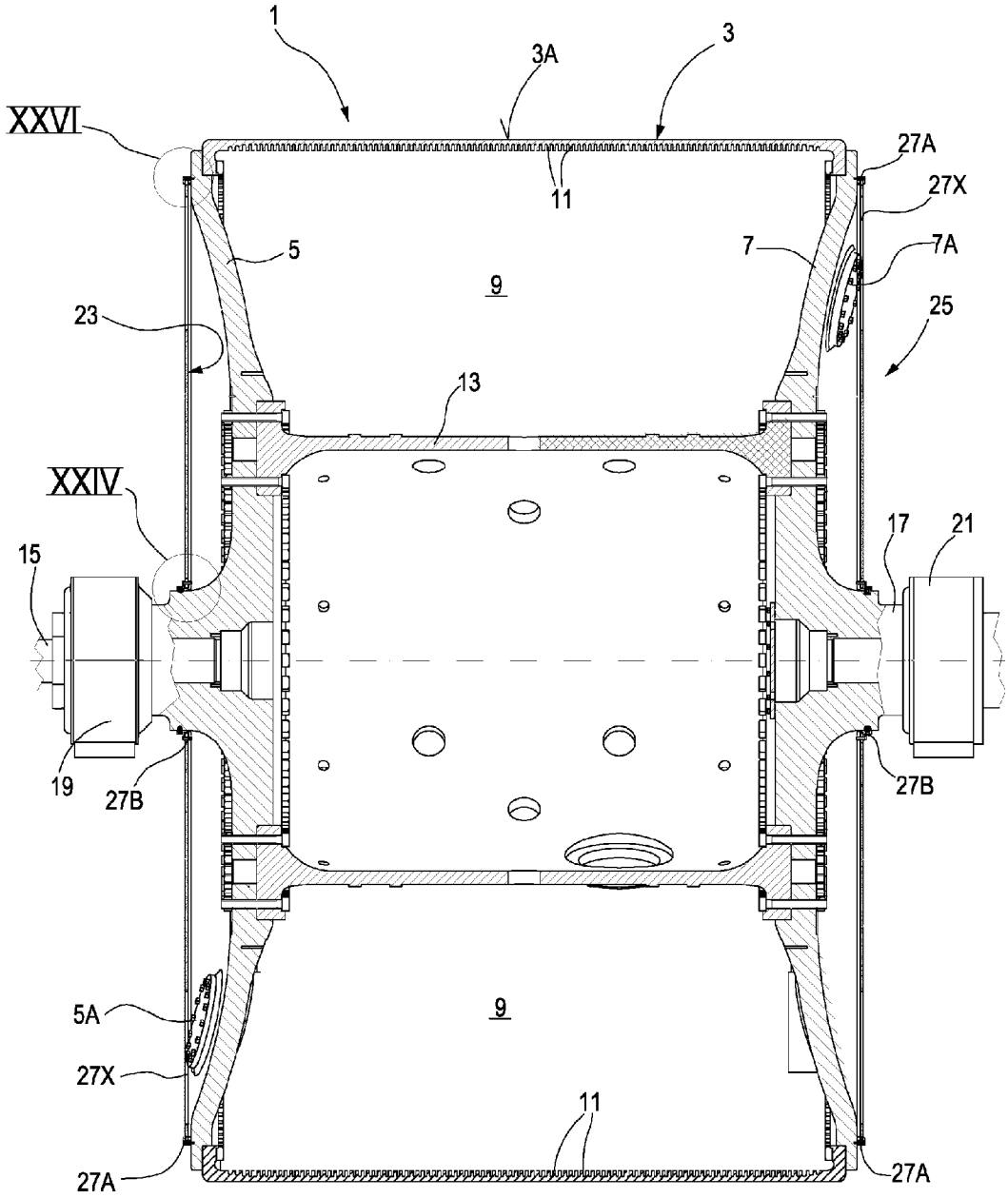
FIG. 23 is a cross-section according to XXIII-XXIII of FIG. 22.

In FIGS. 22 and 23, number 1 indicates the Yankee cylinder as a whole. The Yankee cylinder comprises for instance a cylindrical body or shell 3 provided with heads 5 and 7. In the example illustrated, the heads 5 and 7 have a round shape, with the concavity facing the outside. In other embodiments, the heads may be flat.

The shell 3 is provided with an outer cylindrical surface 3A and forms, together with the heads 5 and 7, a closed space 9, inside which a heat-transfer fluid, such as steam, flows. The heat-transfer fluid circulating inside the Yankee cylinder 1 releases heat to both the heads 5, 7 and the shell 3. A ply of cellulose material is driven around the Yankee cylinder; this ply shall be at least partially dried by means of the heat transferred from the steam or other heat-transfer fluid through the cylindrical shell 3. The inner surface of the cylindrical shell 3 may be provided, in a known manner, with annular grooves 11, where ducts (not shown) end for sucking the condensate collected in the grooves 11 as a result of the transfer of the latent heat of vaporization through the shell 3 during the operation of the Yankee cylinder. The heads 5 and 7 may be joined by means of an inner tie rod 13.

The heads are provided with respective support and rotation journals indicated with 15 and 17. These journals 15 and 17 may be inserted inside support bearings, for instance ball bearings schematically indicated with 19 and 21.

In some embodiments, one or both the heads 5 and 7 may be provided with a manhole 5A, 7A to access the space 9 of the Yankee cylinder, for instance for maintenance or control.

A thermal insulation is associated with each head 5, 7, namely a thermal insulation 23 associated with the head 5 and a thermal insulation 25 with the head 7. The two thermal insulations 23 and 25 may be substantially mirror-like, and therefore only one of them will be described below.

As shown in particular in the front view of FIG. 22, in some embodiments the insulation system may comprise a plurality of adjacent insulation panels 27, so as to form an annulus substantially extending from the respective support and rotation journal 15, 17 up to the most external circumferential area of the head 5, 7, near the area where the head is fixed to the shell 3, for instance by means of bolts 29 (as shown) or by welding.

Eight insulation panels 27 are provided in the illustrated example (see in particular FIG. 22). The number of insulation panels 27 may be also different. In some embodiments, at least one insulation panel 27 may be provided with an opening 27X for accessing the respective manhole 5A, 7A provided in the respective head 5, 7. The opening 27X is advantageously closed by means of a removable lid, provided with a thermal insulation and/or a gasket.

Each insulation panel 27 may advantageously have an outer circumferential edge 27A, an inner circumferential edge 27B (see FIGS. 24, 25), and two preferably nearly rectilinear radial edges 27C (FIG. 22).

Each insulation panel 27 may comprise a wall 31 with an outer circumferential edge 31C and an inner circumferential edge 31A and radial edges 31B. The wall 31 may be made of metal sheet, for instance of steel. The edges 31A, 31B, and 31C may be bent to form a space 10 for containing a thermal insulating material 35. As in the previous embodiments described above, the thermal insulating material 35 may be constituted by a sheet and/or plates with a composition like that described above, obtained by distributing a liquid or viscous material onto a suitable structure, and then solidifying and hardening this material to form the sheets or plates. These sheets or plates are then advantageously glued to the inner surface of the wall 31, i.e. the surface facing a cover 37 that, together with the wall 31 and the edges 31A, 31B and 31C thereof, forms a case for housing, containing and protecting the thermal insulating material 35.

The layer of thermal insulating material 35 applied onto the panel 27 may have a thickness comprised between 15 and 30 mm.

Figure 32:
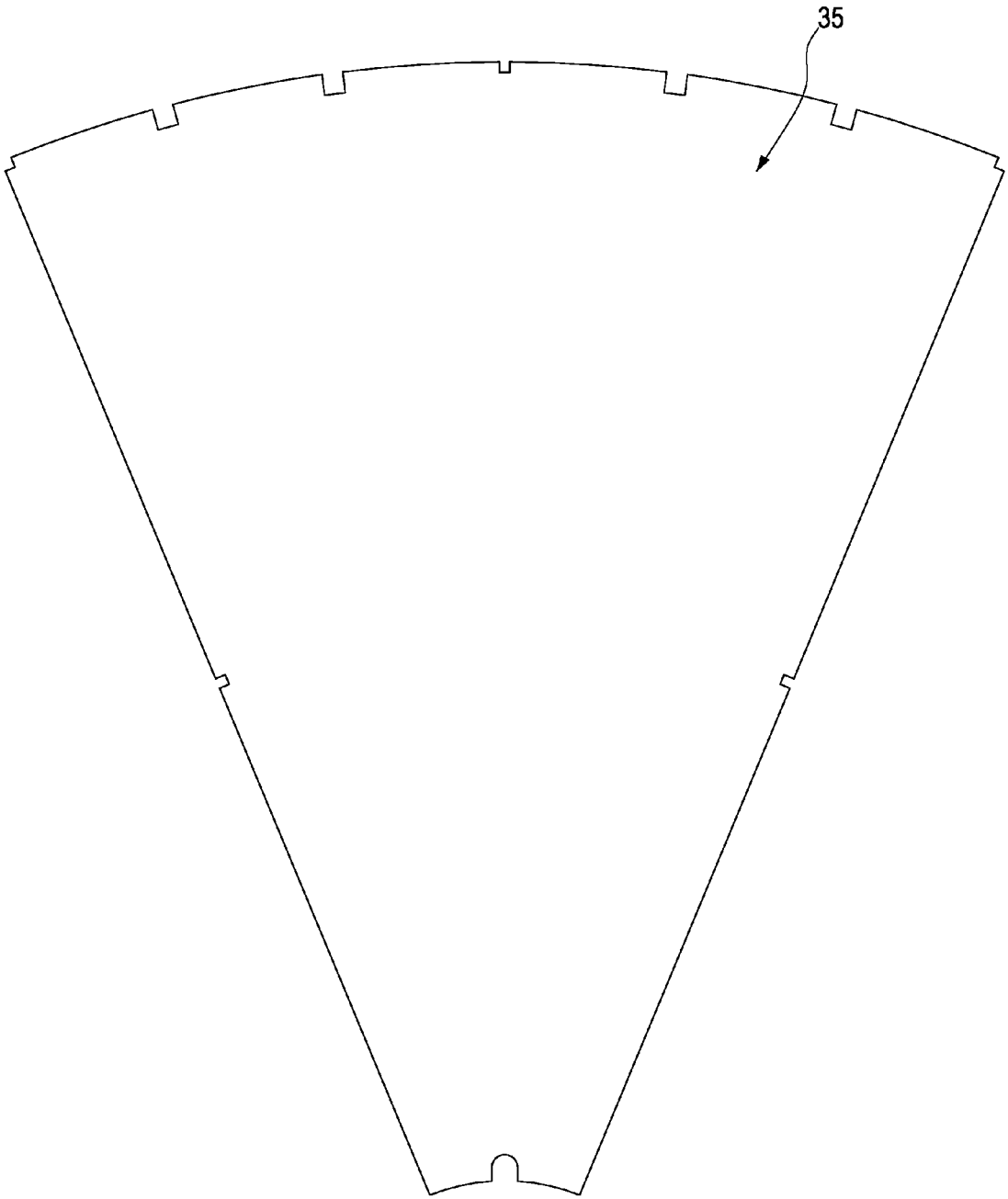
FIG. 32 is a front view of a panel of insulating material of the insulation structure of FIGS. 22 and 23.

FIG. 32 shows a front view of an embodiment of a plate of thermal insulating material 35 suitable to be housed in the case or shell formed by the wall 31 and the cover 37.

The panel 27 is mounted onto the head preferably in such a position that the wall 31 faces the respective head and the cover 37 faces the outside.

The cover 37 is advantageously contained inside the edges 31A, 31B, 31C of the wall 31. To protect the thermal insulating material 35, the wall 31 and the cover 37 of each insulation panel 27 may be welded together or joined together by means of a gasket.

Figure 27:
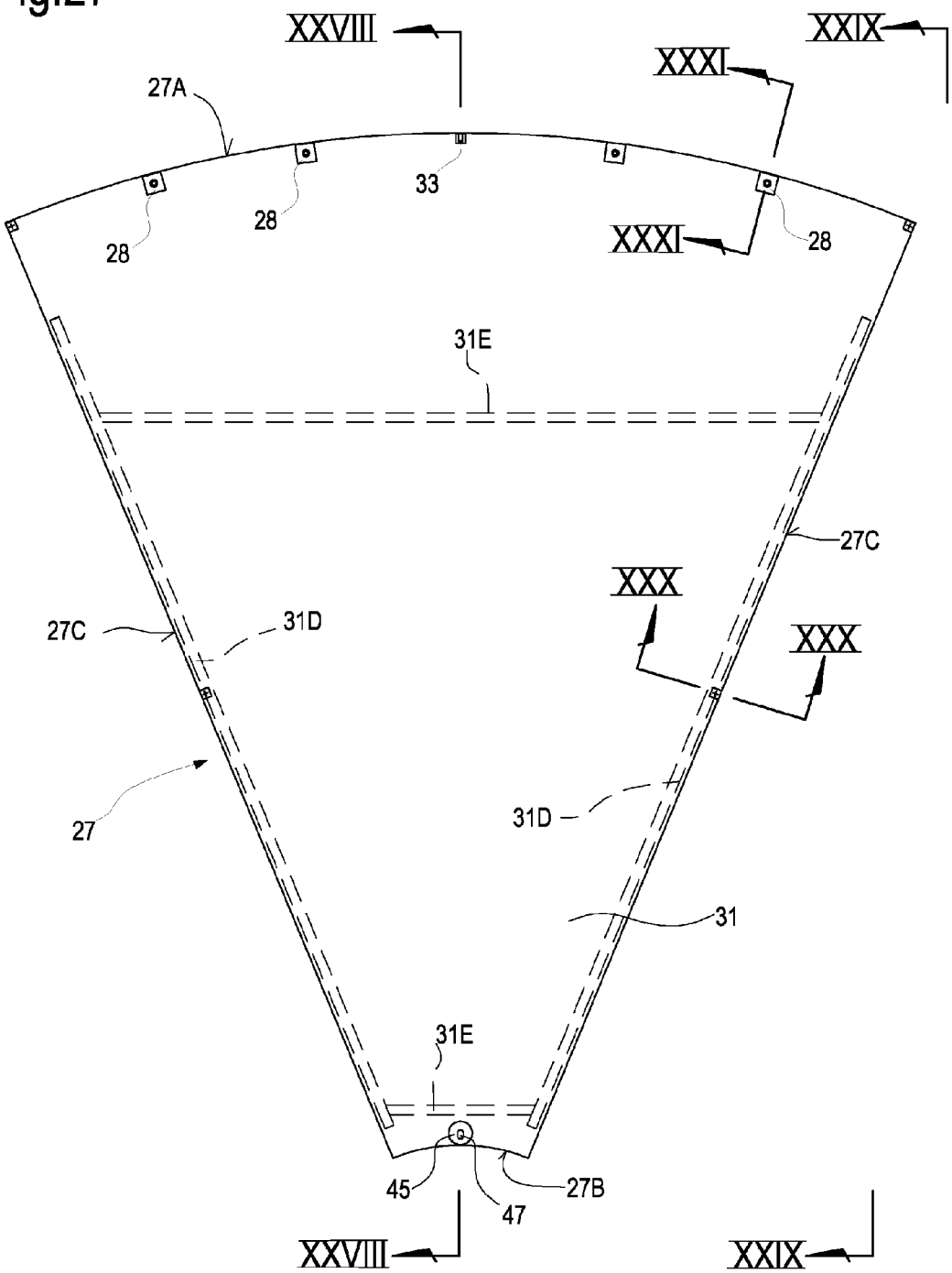
FIG. 27 is a front view of an insulation element of FIGS. 22, 23.
Figure 28:
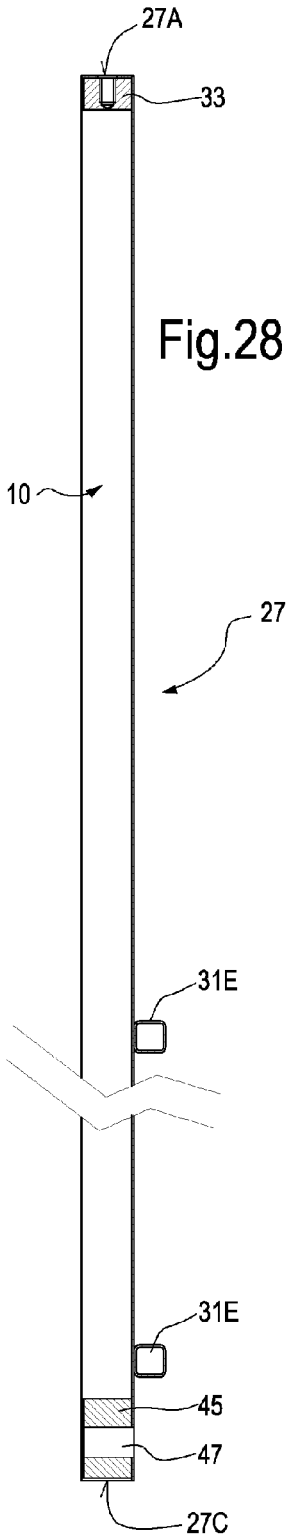
FIG. 28 is a cross-section according to XXVIII-XXVIII of FIG. 27.
Figure 29:
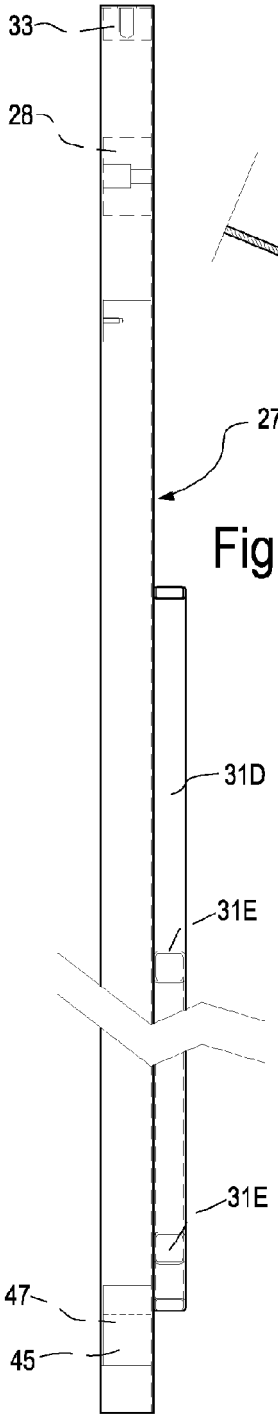
FIG. 29 is a view according to XXIX-XXIX of FIG. 27.
Figure 30:
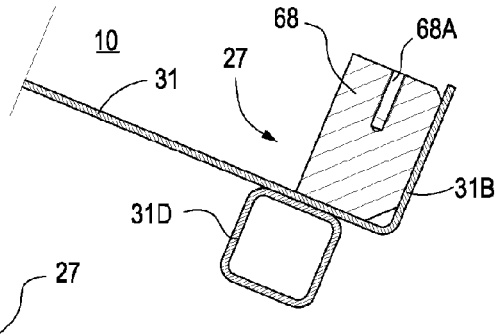
FIGS. 30 and 31 are cross-sections according to the lines XXX-XXX and XXXI-XXXI of FIG. 27.
Figure 31:
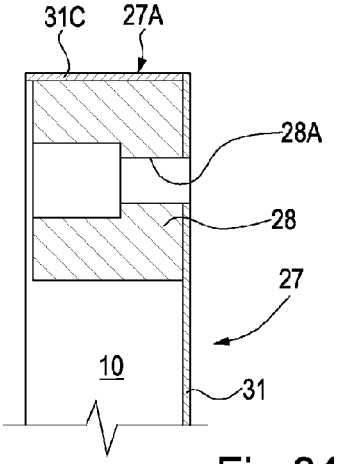

FIG. 27 shows a front view of a wall 31, and FIGS. 28 and 29 show views and cross-sections according to the lines XXVIII-XXVIII and XXIX-XXIX respectively. Each wall 31 and therefore each panel 27 may be shaped like a segment of an annulus.

Inserts 28 (see in particular FIG. 25) may be provided along the outer circumferential edge 27A of each panel 27; these inserts are welded to the wall 31, and each of them has a through hole 28A for a screw 30 for fastening the wall 31, and therefore the panel 27, to the head. The single panels 27 are fastened to the head along the outer circumferential edge 27A also by using fastening brackets or clamps 59 provided with through holes 59A for screws 60 (FIG. 26).

In advantageous embodiments each bracket 59 has a sufficient length, in circumferential direction, to block two adjacent insulation panels 27 in correspondence of corresponding angles, each bracket 59 being applied in correspondence of two adjacent radial edges 27C of two consecutive insulation panels 27, as it is shown in particular in FIG. 22.

In this way, each panel is blocked along the respective outer circumferential edge 27A by means of two brackets 59 and respective screws 60 and by means of a plurality of screws 30 inserted in the inserts 28.

In some embodiments, an insert 33 may be provided (see FIGS. 28, 29) in a central position of each panel 27, fixed to the wall 31 and provided with a threaded hole for engaging a ringbolt (not shown), analogously to what described with reference to the embodiments of FIGS. 1 to 19.

In some embodiments, along the outer circumferential edge 27A of the single panel 27 a high-temperature gasket 39 may be provided, that is inserted between the surface of the wall 31 facing the respective head 5 or 7 and the said head (FIG. 26). In advantageous embodiments, the gasket 39 has a C- or U-shaped cross-section, so as to surround all the outer circumferential edge 27A of the panel 27 and to be interposed also between the cover 37 and the fastening brackets or clamps 59.

The gasket 39 may be made of suitable temperature-resistant and hard silicone materials. Silicones may be for instance used with Shore hardness 70±5 and able to resist peak temperatures in the order of 300° C.

In some embodiments, a holed disk 45 (FIG. 24) is provided in a central area, preferably on the centerline plane of the panel 27, adjacent to the inner circumferential edge 27B; this disk is housed inside the space 10 delimited by the wall 31 and by the edges thereof and is welded to said wall. The holed disk 45 has a through axial hole 47 for a locking screw used to fasten the insulation panel 27 to a mounting ring 49 that is fixed to the support and rotation journal 15, 17 of the respective head 5, 7.

The mounting ring 49 may be comprised of a plurality of portions, for instance of two semi-annular portions. In advantageous embodiments, the two semi-annular portions of the mounting ring 49 may be fastened to the respective support and rotation journal 15, 17 by means of screws 51 (see in particular the detail of FIG. 24) that are inserted into holes 49C of the ring 49.

In some embodiments, the ring 49 may be provided with an annular groove 49D (FIG. 24), delimited by two annular projections 49E, 49F projecting radially from the mounting ring 49.

Once the ring has been mounted (see FIG. 24), the groove 49D receives the inner circumferential edge 27B of each insulation panel 27. The holed disk 45 of each insulation panel 27 is arranged with the hole 47 in correspondence of two opposite holes 49G and 4911 provided on the annular projections 49E, 49F of the mounting ring 49. The hole 49G may be a smooth through hole, whilst the hole 49H may be threaded. In this way each insulation panel 27 may be fixed by means of a through screw 55 that extends through the hole 49G and the through hole 47 of the disk 45 and is screwed in the threaded hole 49H of the mounting ring 49.

Similarly, the through hole 47 of the disk 45 may have a greater diameter than the diameter of the screw 55 or, as in the illustrated example, it may have an elongated shape in radial direction, i.e. be shaped like a slot. In this way a reciprocal radial movement is possible between the insulation panel 27 and the head that can be determined by means of temperature differentials and therefore different thermal expansions.

In some embodiments, a high-temperature gasket 57 may be interposed between the inner surfaces of the groove 49D and the insulation panel 27. The gasket 57 advantageously has a U- or C-shaped cross-section and avoids the direct contact between the mounting ring 49 and the insulation panel 27.

Gaskets with C- or U-shaped cross-sections may be applied along the radial edges 27C of the single panels, similar to the gaskets 39 and 57, to seal them and compensate any clearance.

To have a greater flexural stiffness of the insulation panels 27, in some embodiments reinforcements may be provided, applied onto the wall 31, preferably on the surface of said wall facing the respective head 5, 7. In the illustrated embodiment, two radial profiles or beams 31D are provided to this end, applied along the radial edges 31C of the wall 31 (see FIGS. 27 and 30). The profiles or beams 31D may have a smaller length than the radial dimension of the panel 27. The two radial profiles or beams 31D may be advantageously joined together by means of transverse profiles or beams 31E. In the illustrated embodiment, two transverse profiles or beams 31E are provided, one near the inner circumferential edge 27B of the panel 27 and the other one in a position radially displaced towards the outer circumferential edge 27A (see FIG. 27).

To improve the fastening of the cover 37 to the wall 31, inserts 68 may be provided along the radial edges 31C of the same wall (FIG. 30); these inserts have threaded holes 68A where locking screws may be inserted for fastening the cover 37 to the wall 31.

Figure 33:
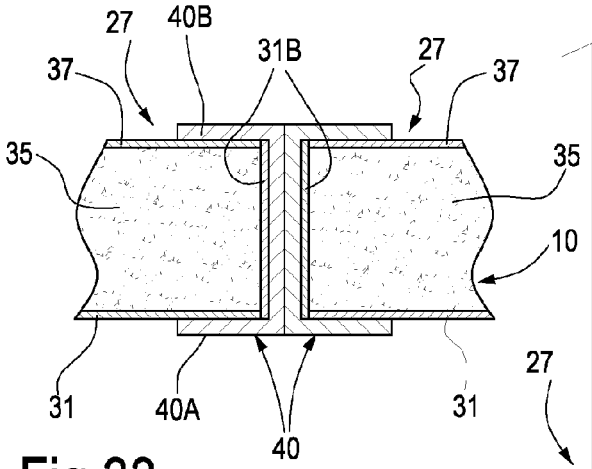
FIG. 33 is an enlarged cross-section according to XXXIII-XXXIII of FIG. 22.

In advantageous embodiments, a separating gasket may be arranged between insulation panels 27 suitable to resist high temperatures. FIG. 33 shows, in a cross-section according to XXXIII-XXXIII of FIG. 22, an embodiment of wherein two radial edges of two insulation panels 27 are adjacent to each other. A respective gasket 40 is applied outside the bent radial edges 31C of the wall 31 of the two insulation panels 27; this gasket may extend also along the outer and the inner surface of the respective insulation panel 27 as indicated in 40A and 40B. In this way an effective seal is achieved also along the radial lines in correspondence of which the two insulation panels 27 are adjacent to each other.

Similar arrangements of gaskets may be used in the embodiments described above.

Figure 34:
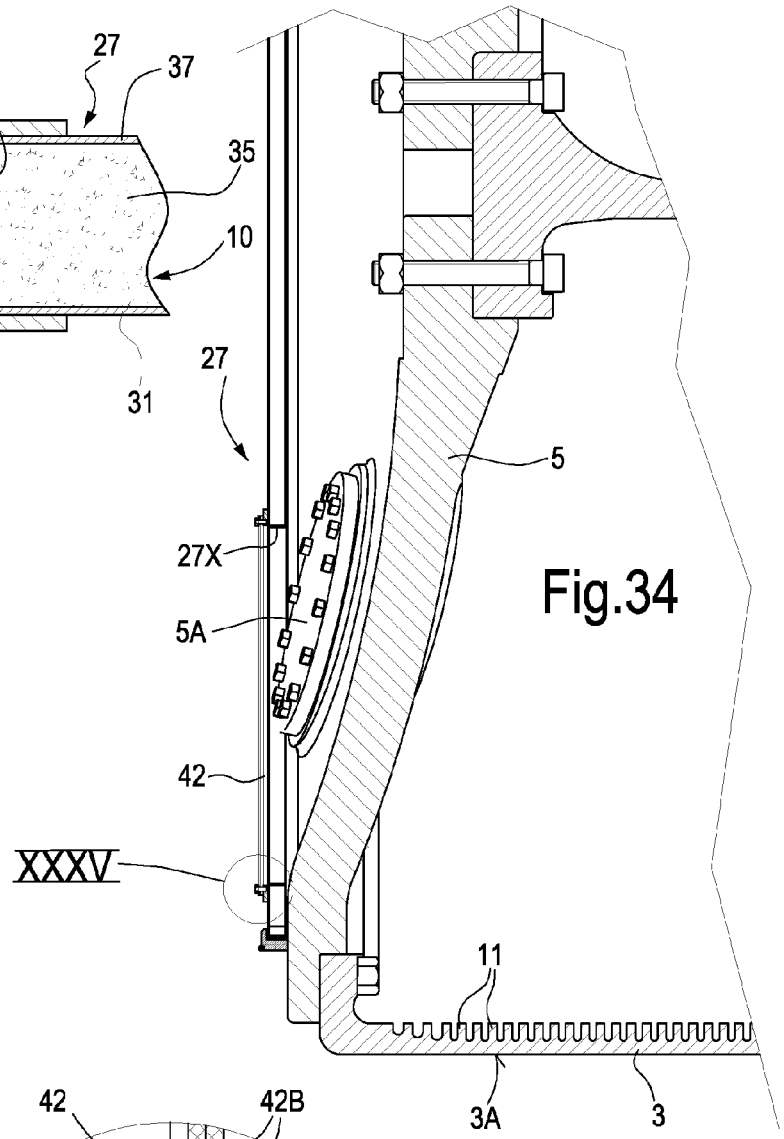
FIG. 34 is an enlargement of the area of the manhole of FIG. 23 in a modified embodiment.
Figure 35:
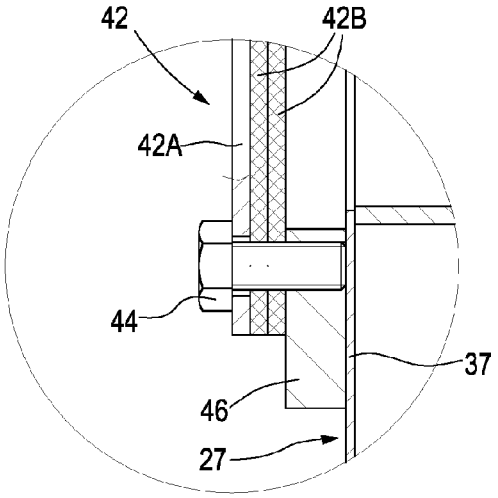
FIG. 35 shows an enlargement of the detail indicated with XXXV in FIG. 34.

FIGS. 34 to 35 show details of an improved insulation system allowing easy access to the manhole 5A provided on the respective head 5. A similar arrangement may be provided for the opposite head. As regards the other features, the embodiment of FIGS. 34 to 35 corresponds to the embodiment of FIGS. 22 to 33. The same insulation of the area of the manhole 5A may be also used in the embodiments illustrated in FIGS. 1 to 21, when a manhole 5A is provided.

As already described above, the insulation panel 27 corresponding to the manhole 5A comprises an opening 27X arranged in correspondence of the manhole 5A. The opening 27X allows accessing the manhole 5A and therefore the inside of the Yankee cylinder 1. To avoid heat losses through the opening 27X, this latter can be advantageously closed by means of a lid 42. The lid 42 may be comprised of an outer panel or sheet 42A and of one or more layers of insulating material 42B, for instance high-temperature gaskets that can be made of a material that to that used in other areas of the insulation system for the Yankee cylinder 1, for instance for producing the gaskets 40. Bolts 44 may be used to fasten the lid 42 to a ring 46 that can be in turn fixed, for instance by welding, onto the cover 37 of the insulation panel 27.

By removing the lid 42 it is possible to access the manhole 5A and therefore enter the Yankee cylinder 1 for maintenance purposes or the like, without the need for disassembling all the insulation system.

Figure 36A:
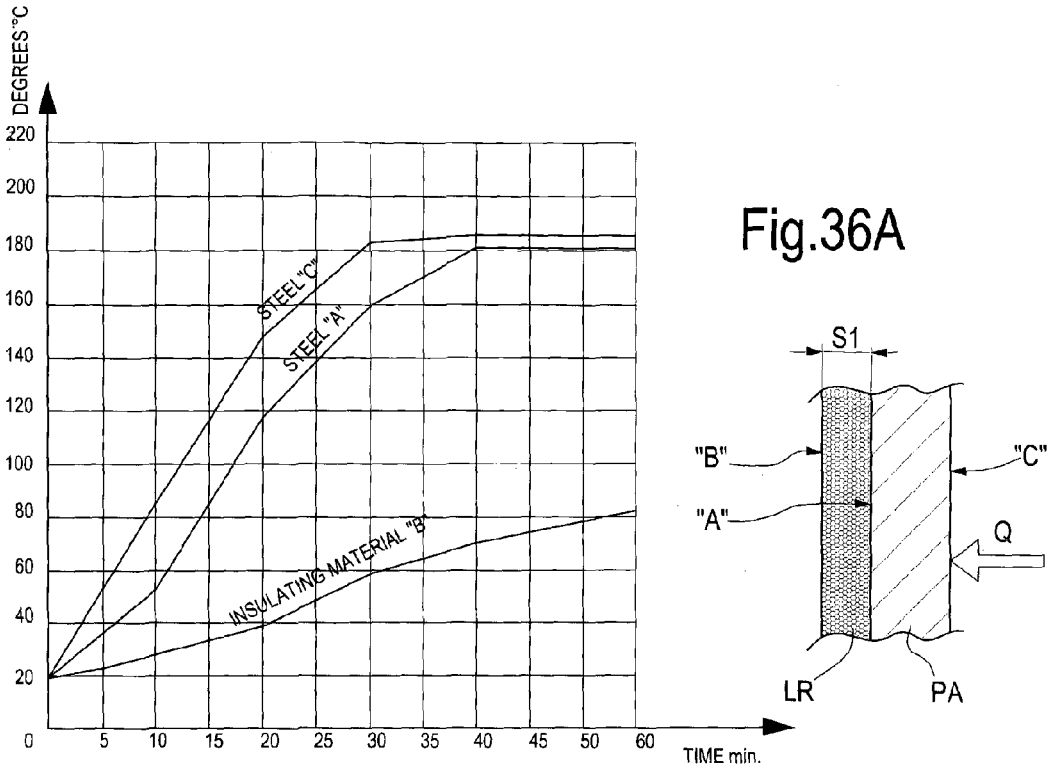
FIGS. 36A and 36B are diagrams comparing the trend of the temperature as a function of time in insulating structures according to the invention with the same trend in prior art insulating structures.
Figure 36B:
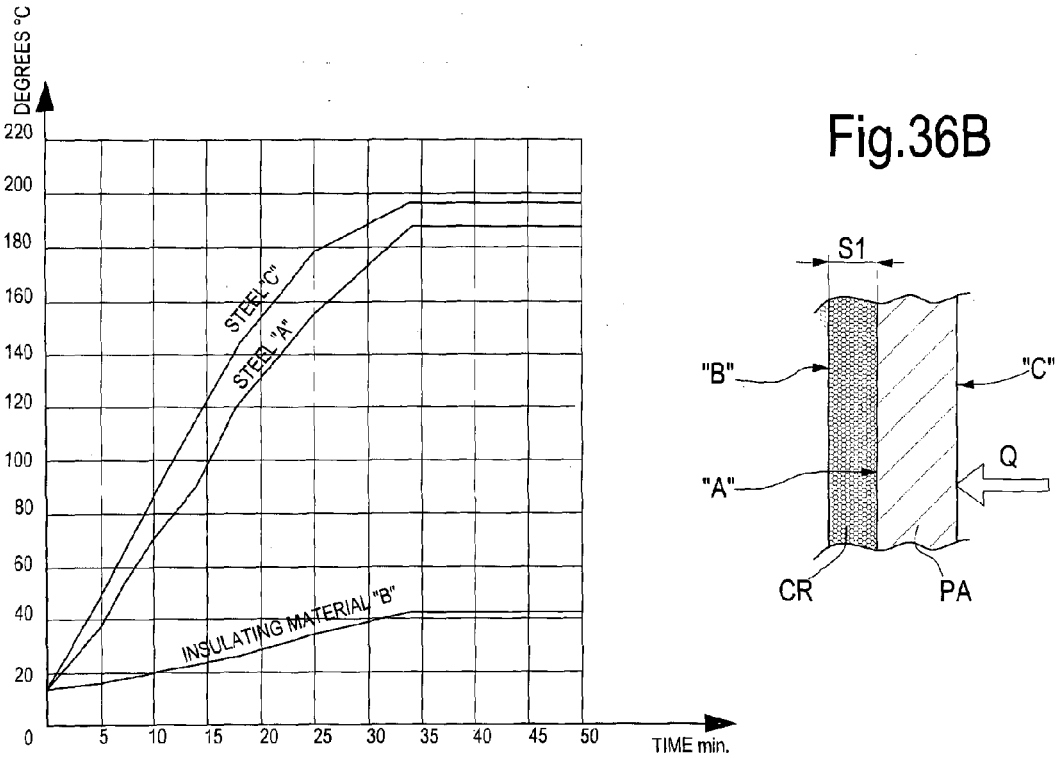

A ceramic- and polymer-based thermal insulating material of the type defined above allows achieving a significantly high efficiency in terms of reduction of the heat flow, with reduced layers of insulating material. FIGS. 36A and 36B show experimental results obtained with prior art insulating materials (FIG. 46A) and materials according to the invention (FIG. 46B) applied onto a steel plate. Each figure shows the experimental structure with which the experiments have been made. In both cases, temperature measurements have been made in a structure where a steel wall PA has been subjected to a heat flow Q by means of a heat source arranged on a side of the same wall. The outer surface of the wall PA, i.e. the surface opposite the heat source Q, has been provided with a layer of insulating material. In FIG. 46A the insulating layer LR is made of rock wool and has a thickness S1 of 20 cm. In FIG. 46B the insulating layer CR is made of the material according to the invention and has a thickness S2. The diagrams of these two figures show the trends of the temperature over time on the surfaces indicated with "C", "A"; and "B" respectively. The temperature trend on the surfaces A and C of the steel wall is the same in both cases. Vice versa, in the case of FIG. 46A the temperature of the outer surface of the insulating layer continues to increase over time up to over 60° C., the temperature on the hot side of the wall PA being 198° C. Vice versa, the temperature of the outer surface of the insulating layer according to the invention achieves a maximum value, around 40° C., when the temperature on the hot side of the wall PA is 198° C., and then stabilizes. The insulating material described herein has therefore a significantly greater efficiency than the prior art materials.

In the description above and in the attached claims a particular composition is indicated for the insulating material, that is constituted by a polymeric matrix where one or more of the following components are dispersed: glass particles, rock wool, clay and/or montmorillonite particles, for instance clay and/or montmorillonite nanoparticles. Various application methods have been described for this material, with particular mechanical structures for retaining and mounting, produced according to the type of component (for instance Yankee cylinder, dryer cylinder, air hood, etc.) to which the insulation shall be applied. It should be understood that the object of the present description is also each of the various structures, configurations, arrangements, assemblies, independently of the chemical composition of the insulating material. In other words, the construction solution for mounting, protecting, containing, and in general the structures described and illustrated herein may be used also with sheets, plates or panels of insulating material of different nature than that described, provided that it is compatible with the suggested use and the mounting methods described and illustrated herein.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A Yankee or dryer cylinder comprising:
a shell and two heads, defining an inner hollow space, inside which a heat-transfer fluid flows;
support and rotation journals fixed to said heads;
a thermal insulation system for the heads, wherein said thermal insulation system comprises, for each of said two heads, a plurality of thermal insulation panels fixed to the Yankee or dryer cylinder, wherein each of said insulation panels comprises a closed space defined in said shell, inside which a thermal insulating material is housed, the closed space being water-proof sealed, the thermal insulating material comprising a polymeric matrix where one or more of the following components are dispersed: glass particles, rock wool, clay particles, montmorillonite particles.

2. A Yankee or dryer cylinder according to claim 1, wherein a combination of said glass particles, said rock wool and one of said clay particles and said montmorillonite particles is dispersed in the polymeric matrix.

3. A Yankee or dryer cylinder according to claim 2, wherein the thermal insulating material is in a form of sheets or plates, at least one of said sheets or plates being fixed inside the closed space of each of said insulation panels.

4. A Yankee or dryer cylinder according to claim 3, wherein each of said insulation panels comprises two approximately rectilinear radial edges that extend between an inner circumferential edge and an outer circumferential edge, said insulation panels being adjacent to one another along the rectilinear radial edges to form a thermal insulation crown.

5. A Yankee or dryer cylinder according to claim 2, wherein each of said insulation panels comprises two approximately rectilinear radial edges that extend between an inner circumferential edge and an outer circumferential edge, said insulation panels being adjacent to one another along the rectilinear radial edges to form a thermal insulation crown.

6. A Yankee or dryer cylinder according to claim 2, wherein each of said insulation panels comprises a wall, made of metal sheet with raised edges, and a cover, and the thermal insulating material is arranged between the wall and the cover, the wall and the cover forming said shell.

7. A Yankee or dryer cylinder according to claim 1, wherein the thermal insulating material is in a form of sheets or plates, at least one of said sheets or plates being fixed inside the closed space of each of said insulation panels.

8. A Yankee or dryer cylinder according to claim 7, wherein each of said insulation panels comprises two approximately rectilinear radial edges that extend between an inner circumferential edge and an outer circumferential edge, said insulation panels being adjacent to one another along the rectilinear radial edges to form a thermal insulation crown.

9. A Yankee or dryer cylinder according to claim 1, wherein each of said insulation panels comprises two approximately rectilinear radial edges that extend between an inner circumferential edge and an outer circumferential edge, said insulation panels being adjacent to one another along the rectilinear radial edges to form a thermal insulation crown.

10. A Yankee or dryer cylinder according to claim 9, wherein each of said journals of the cylinder is provided with a mounting ring for the insulation panels, said mounting ring being provided with a fastening means for fixing the insulation panels along respective inner circumferential edges of said insulation panels.

11. A Yankee or dryer cylinder according to claim 10, wherein high-temperature gaskets are provided along at least one of the inner circumferential edge of each of said insulation panels and the outer circumferential edge of each of said insulation panels, said high-temperature gaskets insulating a respective panel from the head or the mounting ring.

12. A Yankee or dryer cylinder according to claim 9, wherein each of said insulation panels is fastened to a respective one of said heads along the outer circumferential edge by means of fastening brackets.

13. A Yankee or dryer cylinder according to claim 12, wherein inserts are arranged along the inner circumferential edge of each of said insulation panels, each of said inserts being provided with a through hole for blocking means fixing the insulation panel to a mounting ring.

14. A Yankee or dryer cylinder according to claim 9, wherein each of said insulation panels is provided, in an intermediate position between the outer circumferential edge and the inner circumferential edge, with at least one intermediate fastening point for fastening to a respective head.

15. A Yankee or dryer cylinder according to claim 1, wherein each of said insulation panels comprises a wall, made of metal sheet with raised edges, and a cover, and the thermal insulating material is arranged between the wall and the cover, the wall and the cover forming said shell.

16. A Yankee or dryer cylinder according to claim 1, further comprising spacing rods interposed between adjacent radial edges of adjacent insulation panels.

17. A Yankee or dryer cylinder according to claim 16, wherein each of said spacing rods comprises a wing forming a cover for the adjacent radial edges of two consecutive insulation panels and from said wing a web extends nearly orthogonally along a longitudinal extension of the wing, said web being inserted between adjacent edges of said two consecutive insulation panels and said web having transverse cuts subdividing the web into portions that can be deformed outwards and on both sides of a median plane where the web lies, to space the insulation panels from one another.

18. A Yankee or dryer cylinder according to claim 1, wherein gaskets are applied along radial edges of the insulation panels.

19. A Yankee or dryer cylinder according to claim 1, wherein at least one of said insulation panels comprises an opening for accessing a manhole provided in a respective head.

20. A Yankee or dryer cylinder according to claim 19, wherein said opening is closed by means of a lid.

21. A Yankee or dryer cylinder according to claim 1, wherein the thermal insulating material comprises a volume containing air of less than ten percent of a total volume of the thermal insulating material.

22. A Yankee or dryer cylinder according to claim 1, wherein the thermal insulating material comprises a volume containing air of less than three percent of a total volume of the thermal insulating material.

23. A Yankee or dryer cylinder according to claim 1, wherein the thermal insulating material comprises a volume containing air of less than two percent of a total volume of the thermal insulating material, the thermal insulating material comprising a solidified dispersing liquid, the insulating material comprising one or more of the glass particles 5% to 40% by weight, the rock wool 5% to 40% by weight, the clay particles 0.5% to 5% by weight, the montmorillonite particles 0.5% to 5% by weight and a polymer 10% to 40% by weight prior to adding a dispersing liquid of the solidified dispersing liquid.

24. A Yankee or dryer cylinder comprising:

a cylinder comprising a shell, a first head structure and a second head structure, the shell, the first head structure and the second head structure defining an inner hollow space, inside which a heat-transfer fluid flows;

a first support and rotation journal structure fixed to the first head structure;

a second support and rotation journal structure fixed to the second head structure;

a first thermal insulation panel connected to one of the first head structure and the second head structure, the first thermal insulation panel comprising a first thermal insulation panel closed space and a first thermal insulating material arranged in the first thermal insulation panel closed space, the first thermal insulation panel being at least liquid impermeable such that at least liquid does not enter the first thermal insulation panel closed space;

a second thermal insulation panel fixed to another one of the first head structure and the second head structure, the second thermal insulation panel comprising a second thermal insulation panel closed space and a second thermal insulating material arranged in the second thermal insulation panel closed space, the second thermal insulation panel being at least liquid impermeable such that at least liquid does not enter the second thermal insulation panel closed space, each of the first thermal insulating material and the second thermal insulating material comprising a polymeric matrix including one or more of glass particles, rock wool, clay particles and montmorillonite particles.

25. A Yankee or dryer cylinder according to claim 24, wherein each of the first thermal insulating material and the second thermal insulating material comprises a volume containing air of less than ten percent of a total volume of the thermal insulating material, each of the first thermal insulating material and the second thermal insulating material comprising a solidified dispersing liquid, the insulating material comprising one or more of the glass particles 5% to 40% by weight, the rock wool 5% to 40% by weight, the clay particles 0.5% to 5% by weight, the montmorillonite particles 0.5% to 5% by weight and a polymer 10% to 40% by weight prior to adding a dispersing liquid of the solidified dispersing liquid.

* * * * *